US006176323B1

(12) United States Patent
Weirich et al.

(10) Patent No.: US 6,176,323 B1
(45) Date of Patent: Jan. 23, 2001

(54) DRILLING SYSTEMS WITH SENSORS FOR DETERMINING PROPERTIES OF DRILLING FLUID DOWNHOLE

(75) Inventors: John B. Weirich, Spring; Ronald G. Bland, Houston; William W. Smith, Jr., The Woodlands, all of TX (US); Volker Krueger, Celle (DE); John W. Harrell, Waxahachie, TX (US); Hatem N. Nasr; Valeri Papanyan, both of Houston, TX (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/111,368

(22) Filed: Jun. 26, 1998

Related U.S. Application Data

(60) Provisional application No. 60/051,614, filed on Jun. 27, 1997.

(51) Int. Cl.[7] ..... E21B 47/00

(52) U.S. Cl. ..... 175/40

(58) Field of Search ..... 175/39, 40, 41, 175/42, 50, 45, 46, 44; 166/250; 73/152.03, 152.01, 152.52, 151, 152

(56) References Cited

U.S. PATENT DOCUMENTS 2,341,745 * 2/1944 Silverman et al. .
2,588,210 * 3/1952 Crisman et al. .

(List continued on next page.)

FOREIGN PATENT DOCUMENTS 0 697 504 A2 2/1996 (EP) .
2 307 684 6/1997 (GB) .
WO 96/321420 * 10/1993 (WO) .
WO 96/02734 * 2/1996 (WO) .
WO 97/27381 * 7/1997 (WO) .
WO 98/50680 11/1998 (WO) .

* cited by examiner

*Primary Examiner*—Robert E. Pezzuto
(74) *Attorney, Agent, or Firm*—Madan, Mossman & Sriram, P.C.

(57) ABSTRACT

The present invention provides a drilling system for drilling oilfield boreholes or wellbores utilizing a drill string having a drilling assembly conveyed downhole by a tubing (usually a drill pipe or coiled tubing). The drilling assembly includes a bottom hole assembly (BHA) and a drill bit. The bottom hole assembly preferably contains commonly used measurement-while-drilling sensors. The drill string also contains a variety of sensors for determining downhole various properties of the drilling fluid. Sensors are provided to determine density, viscosity, flow rate, clarity, compressibility, pressure and temperature of the drilling fluid at one or more downhole locations. Chemical detection sensors for detecting the presence of gas (methane) and $H_2S$ are disposed in the drilling assembly. Sensors for determining fluid density, viscosity, pH, solid content, fluid clarity, fluid compressibility, and a spectroscopy sensor are also disposed in the BHA. Data from such sensors may is processed downhole and/or at the surface. Corrective actions are taken based upon the downhole measurements at the surface which may require altering the drilling fluid composition, altering the drilling fluid pump rate or shutting down the operation to clean wellbore. The drilling system contains one or more models, which may be stored in memory downhole or at the surface. These models are utilized by the downhole processor and the surface computer to determine desired fluid parameters for continued drilling. The drilling system is dynamic, in that the downhole fluid sensor data is utilized to update models and algorithms during drilling of the wellbore and the updated models are then utilized for continued drilling operations.

64 Claims, 9 Drawing Sheets

U.S. PATENT DOCUMENTS

| | | | | |
|---|---|---|---|---|
| 2,805,346 | * | 9/1957 | Piety . | |
| 2,908,817 | * | 6/1959 | McKay . | |
| 3,327,527 | * | 6/1967 | Arps . | |
| 3,885,429 | * | 5/1975 | Megyeri . | |
| 4,091,881 | * | 5/1978 | Maus | 175/7 |
| 4,195,349 | * | 3/1980 | Balkanli . | |
| 4,297,880 | * | 11/1981 | Berger . | |
| 4,454,756 | * | 6/1984 | Sharp et al. | 73/151 |
| 4,655,511 | * | 4/1987 | Rodney et al. . | |
| 4,683,944 | | 8/1987 | Curlett . | |
| 4,765,183 | | 8/1988 | Coury . | |
| 4,805,449 | | 2/1989 | Das . | |
| 4,807,469 | | 2/1989 | Hall . | |
| 4,813,495 | * | 3/1989 | Leach | 175/6 |
| 4,833,915 | | 5/1989 | Radd et al. . | |
| 4,844,183 | | 7/1989 | Tolle . | |
| 4,941,951 | | 7/1990 | Sheppard et al. . | |
| 4,994,671 | | 2/1991 | Safinya et al. . | |
| 5,327,984 | | 7/1994 | Rasi et al. . | |
| 5,351,532 | | 10/1994 | Hager . | |
| 5,435,176 | | 7/1995 | Manchak, III . | |
| 5,517,024 | | 5/1996 | Mullins et al. . | |
| 5,581,024 | | 12/1996 | Meyer, Jr. et al. . | |
| 5,679,894 | | 10/1997 | Kruger et al. . | |
| 5,715,895 | * | 2/1998 | Champness et al. | 175/17 |

DRILLING SYSTEMS WITH SENSORS FOR DETERMINING PROPERTIES OF DRILLING FLUID DOWNHOLE

CROSS-REFERENCE TO RELATED APPLICATION

This application takes priority from U.S. patent application Ser. No. 60/51,614 filed on Jun. 27, 1997.

BACKGROUND OF THE INVENTION

1. Field of the Invention

This invention relates generally to drilling systems for forming or drilling wellbores or boreholes for the production of hydrocarbons from subsurface formations and more particularly to drilling systems utilizing sensors for determining downhole parameters relating to the fluid in the wellbore during drilling of the wellbores. The measured fluid parameters include chemical properties including chemical composition (gas, pH, $H_2S$, etc.), physical properties including density, viscosity, clarity, lubricity, color, compressibility, accumulation of cuttings, pressure and temperature profiles or distribution along wellbores. This invention further relates to taking actions based at least in part on the downhole measured fluid parameters, including adjusting the properties of the drilling fluid supplied from the surface, fluid flow rate, hole cleaning, and taking corrective actions when a kick is detected, thereby improving the efficiency and effectiveness of the drilling operations.

2. Description of the Related Art

To recover oil and gas from subsurface formations, wellbores (also referred to as boreholes) are drilled by rotating a drill bit attached at an end of a drill string. The drill string includes a drill pipe or a coiled tubing (referred herein as the "tubing") that has a drill bit at its downhole end and a bottomhole assembly (BHA) above the drill bit. The wellbore is drilled by rotating the drill bit by rotating the tubing and/or by a mud motor disposed in the BHA. A drilling fluid commonly referred to as the "mud") is supplied under pressure from a surface source into the tubing during drilling of the to wellbore. The drilling fluid operates the mud motor (when used) and discharges at the drill bit bottom. The drilling fluid then returns to the surface via the annular space (annulus) between the drill string and the wellbore wall or inside. Fluid returning to the surface carries the rock bits (cuttings) produced by the drill bit as it disintegrates the rock to drill the wellbore.

In overburdened wellbores (when the drilling fluid column pressure is greater than the formation pressure), some of the drilling fluid penetrates into the formation, thereby causing a loss in the drilling fluid and forming an invaded zone around the wellbore. It is desirable to reduce the fluid loss into the formation because it makes it more difficult to measure the properties of the virgin formation, which are required to determine the presence and retrievability of the trapped hydrocarbons. In underbalanced drilling, the fluid column pressure is less than the formation pressure, which causes the formation fluid to enter into the wellbore. This invasion may reduce the effectiveness of the drilling fluid.

A substantial proportion of the current drilling activity involves directional boreholes (deviated and horizontal boreholes) and/or deeper boreholes to recover greater amounts of hydrocarbons from the subsurface formations and also to recover previously unrecoverable hydrocarbons. Drilling of such boreholes require the drilling fluid to have complex physical and chemical characteristics. The drilling fluid is made up of a base such as water or synthetic material and may contain a number of additives depending upon the specific application. A major component in the success the drilling operation is the performance of the drilling fluid, especially for drilling deeper wellbores, horizontal wellbores and wellbores in hostile environments (high temperature and pressure). These environments require the drilling fluid to excel in many performance categories. The drilling operator and the mud engineer determine the type of the drilling fluid most suitable for the particular drilling operations and then utilize various additives to obtain the desired performance characteristics such as viscosity, density, gelation or thixotropic properties, mechanical stability, chemical stability, lubricating characteristics, ability to carry cuttings to the surface during drilling, ability to hold in suspension such cuttings when fluid circulation is stopped, environmental harmony, non-corrosive effect on the drilling components, provision of adequate hydrostatic pressure and cooling and lubricating impact on the drill bit and BHA components.

A stable borehole is generally a result of a chemical and/or mechanical balance of the drilling fluid. With respect to the mechanical stability, the hydrostatic pressure exerted by the drilling fluid in overburdened wells is normally designed to exceed the formation pressures. This is generally controlled by controlling the fluid density at the surface. To determine the fluid density during drilling, the operators take into account prior knowledge, the behavior of rock under stress, and their related deformation characteristics, formation dip, fluid velocity, type of the formation being drilled, etc. However, the actual density of the fluid is not continuously measured downhole, which may be different from the density assumed by the operator. Further, the fluid density downhole is dynamic, i.e., it continuously changes depending upon the actual drilling and borehole conditions, including the downhole temperature and pressure. Thus, it is desirable to determine density of the wellbore fluid downhole during the drilling operations and then to alter the drilling fluid composition at the surface to obtain the desired density and/or to take other corrective actions based on such measurements. The present invention provides drilling apparatus and methods for downhole determination of the fluid density during the drilling of the wellbores.

It is common to determine certain physical properties in the laboratories from fluid samples taken from the returning wellbore fluid. Such properties typically include fluid compressibility, rheology, viscosity, clarity and solid contents. However, these parameters may have different values downhole, particularly near the drill bit than at the surface. For example, the fluid viscosity may be different downhole than the viscosity determined at the surface even after accounting for the effect of downhole pressure and temperature and other factors. Similarly, the compressibility of the drilling fluid may be different downhole than at the surface. If a gas zone is penetrated and the gas enters the drilling fluid, the compressibility of drilling fluid can change significantly. The present invention provides drilling apparatus and methods for determining in-situ the above-noted physical parameters during drilling of the wellbores.

Substantially continuous monitoring of pressure gradient and differential pressure between the drill string inside and the annulus can provide indication of to kicks, accumulation of cuttings and washed zones. Monitoring of the temperature gradient can qualitative measure of the performance of the drilling fluid and the drill bit. The present invention provides distributed sensors along the drill string to determine the pressure and temperature gradient and fluid flow rate at selected locations in the wellbore.

Downhole determination of certain chemical properties of the drilling fluid can provide on-line information about the drilling conditions. For example, presence of methane can indicate that the drilling is being done through a gas bearing formation and thus provide an early indication of a potential kick (kick detection). Oftentimes the presence of gas is detected when the gas is only a few hundred feet below the surface, which sometimes does not allow the operator to react and take preventive actions, such as closing valves or shutting down drilling to prevent a blow out. The present invention provides an apparatus and method for detecting the presence of gas and performs kick detection.

Corrosion of equipment in the wellbore is usually due to the presence of carbon dioxide, hydrogen sulphide ($H_2S$) and oxygen. Low pH and salt contaminated wellbore fluids are more corrosive. Prior art does not provide any methods for measuring the pH of drilling fluid or the presence of $H_2S$ downhole. The returning wellbore fluid is analyzed at the surface to determine the various desired chemical properties of the drilling fluid. The present invention provides method for determining downhole certain chemical properties of the wellbore fluid.

As noted above, an important function of the drilling fluid is to transport cuttings from the wellbore as the drilling progresses. Once the drill bit has created a drill cutting, it should be removed from under the bit. If the cutting remains under the bit it is redrilled into smaller pieces, adversely affecting the rate of penetration, bit life and mud properties. The annular velocity needs to be greater than the slip velocity for cuttings to move uphole. The size, shape and weight of the cuttings determine the viscosity necessary to control the rate of settling through the drilling fluid. Low shear rate viscosity controls the carrying capacity of the drilling fluid. The density of the suspending fluid has an associated buoyancy effect on cuttings. An increase in density usually has an associated favorable affect on the carrying capacity of the drilling fluid. In horizontal wellbores, heavier cuttings can settle on the bottom side of the wellbore if the fluid properties and fluid speed are not adequate. Cuttings can also accumulate in washed-out zones. Prior art drilling tools do not determine density of the fluid downhole and do not provide an indication of whether cuttings are settling or accumulating at any place in the wellbore. The present invention utilizes downhole sensors and devices to determine the density of the fluid downhole and to provide an indication whether excessive cuttings are present at certain locations along the borehole.

In the oil and gas industry, various devices and sensors have been used to determine a variety of downhole parameters during drilling of wellbores. Such tools are generally referred to as the measurement-while-drilling (MWD) tools. The general emphasis of the industry has been to use MWD tools to determine parameters relating to the formations, physical condition of the tool and the borehole. Very few measurements are made relating to the drilling fluid. The majority of the measurements relating to the drilling fluid are made at the surface by analyzing samples collected from the fluid returning to the surface. Corrective actions are taken based on such measurements, which in many cases take a long time and do not represent the actual fluid properties downhole.

The present invention addresses several of the above-noted deficiencies and provides drilling systems for determining downhole various properties of the wellbore fluid during the drilling operations, including temperature and pressures at various locations, fluid density, accumulation of cuttings, viscosity, color, presence of methane and hydrogen sulphide, pH of the fluid, fluid clarity, and fluid flow rate along the wellbore. Parameters from the downhole measurements may be computed by a downhole computer or processor or at the surface. A surface computer or control system displays necessary information for use by the driller and may be programmed to automatically take certain actions, activate alarms if certain unsafe conditions are detected, such as entry into a gas zone, excessive accumulation of cuttings downhole, etc. are detected. The surface computer communicates with the downhole processors via a two-way telemetry system.

SUMMARY OF THE INVENTION

The present invention provides a drilling system for drilling oilfield wellbores. A drilling assembly or bottom hole assembly (BHA) having a drill bit at an end is conveyed into the wellbore by a suitable tubing such as a drill pipe or coiled tubing. The drilling assembly may include a drill motor for rotating the drill bit. A drilling fluid is supplied under pressure from a source thereof at the surface into the tubing. The drilling fluid discharges at the drill bit bottom. The drilling fluid along with the drill cuttings circulates to the surface through the wellbore annulus. One or more shakers or other suitable devices remove cuttings from the returning fluid. The clean fluid discharges into the source.

In one embodiment, a plurality of pressure sensors are disposed, spaced apart, at selected locations in the drilling assembly and along the drill string to determine the pressure gradient of the fluid inside the tubing and in the annulus. The pressure gradient may be utilized to determine whether cuttings are accumulating within a particular zone. If the pressure at any point is greater than a predetermined value, or is approaching a leak off test (LOT) pressure or the pressure integrity test (PIT) pressure, the system provides a warning to the operator to clean the wellbore prior to further drilling of the wellbore. The pressure difference between zones determined from the distributed pressure sensor measurements also can provide an indication of areas or depths where the cuttings have accumulated. Any step change in the pressure gradient is an indication of a localized change in the density of the fluid. The distributed pressure measurements along the wellbore in conjunction with temperature measurements can also be utilized to perform reservoir modeling while the wellbore is being drilled instead of conducting expensive tests after the wellbore has been drilled. Such modeling at this early stage can provide useful information about the reservoirs surrounding the wellbore. Additionally, differential pressure sensors may be disposed at selected locations on the drill string to provide pressure difference between the pressure of the fluid inside the drill string and the fluid in the annulus.

Fluid flow measuring devices may be disposed in the drill string to determine the fluid flow through the drill string and the annulus at selected locations along the wellbore. This information may be utilized to determine the fluid loss into the formation in the zones between the flow sensor locations and to determine wash out zones.

A plurality of temperature sensors are likewise disposed to determine the temperature of the fluid inside the tubing and the drilling assembly and the temperature of the fluid in the annulus near the drill bit, along the drilling assembly and along the tubing. A distributed temperature sensor arrangement can provide the temperature gradient from the drill bit to any location on the drill string. Extreme localized temperatures can be detrimental to the physical and/or chemical properties of the drilling fluid. Substantially continuous monitoring of the distributed temperature sensors provides an indication of the effectiveness of the drilling fluid.

In the embodiments described above or in an alternative embodiment, one or more acoustic sensors are disposed in the drill string. The acoustic sensors preferably are ultrasonic sensors to determine reflections of the ultrasonic signals from elements within the borehole, such as suspended or accumulated cuttings. The response of such sensors is utilized to determine the accumulation of cuttings in the wellbore during drilling. A plurality of ultrasonic sensors disposed around the drill string can provide an image of the wellbore fluid in the annulus. The depth of investigation may be varied by selecting a suitable frequency from a range of frequencies. A plurality of such sensor arrangements can provide discretely disposed along the drill string can provide such information over a significant length of the drill string.

The drill string also contains a variety of sensors for determining downhole various properties of the wellbore fluid. Sensors are provided to determine density, viscosity, flow rate, pressure and temperature of the drilling fluid at one or more downhole locations. Chemical detection sensors for detecting the presence of gas (methane), $CO_2$ and $H_2S$ are disposed in the drilling assembly. Sensors for determining fluid density, viscosity, pH, solid content, fluid clarity, fluid compressibility, and a spectroscopy sensor are also disposed in the BHA. Data from such sensors is processed downhole and/or at the surface. Based upon the downhole measurements corrective actions are taken at the surface which may require altering the drilling fluid composition, altering the drilling fluid pump rate or shutting down the operation to clean the wellbore. The drilling system contains one or more models, which may be stored in memory downhole or at the surface. These models are utilized by the downhole processor and the surface computer to determine desired fluid parameters for continued drilling. The drilling system is dynamic, in that the downhole fluid sensor data is utilized to update models and algorithms during drilling of the wellbore and the updated models are then utilized for continued drilling operations.

Examples of the more important features of the invention thus have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawings, in which like elements have been given like numerals and wherein.

DESCRIPTION OF THE PREFERRED EMBODIMENTS

In general, the present invention provides a drilling system for drilling oilfield boreholes or wellbores utilizing a drill string having a drilling assembly conveyed downhole by a tubing (usually a drill pipe or coiled tubing). The drilling assembly includes a bottom hole assembly (BHA) and a drill bit. The bottom hole assembly preferably contains commonly used measurement-while-drilling sensors. The drill string also contains a variety of sensors for determining downhole various properties of the wellbore fluid. Sensors are provided to determine density, viscosity, flow rate, pressure and temperature of the drilling fluid at one or more downhole locations. Chemical detection sensors for detecting the presence of gas (methane), $CO_2$ and $H_2S$ are disposed in the drilling assembly. Sensors for determining fluid density, viscosity, pH, solid content, fluid clarity, fluid compressibility, and a spectroscopy sensor are also disposed in the BHA. Data from such sensors may is processed downhole and/or at the surface. Corrective actions are taken based upon the downhole measurements at the surface which may require altering the drilling fluid composition, altering the drilling fluid pump rate or shutting down the operation to clean the wellbore. The drilling system contains one or more models, which may be stored in memory downhole or at the surface. These models are utilized by the downhole processor and the surface computer to determine desired fluid parameters for continued drilling. The drilling system is dynamic, in that the downhole fluid sensor data is utilized to update models and algorithms during drilling of the wellbore and the updated models are then utilized for continued drilling operations.

Figure 1:
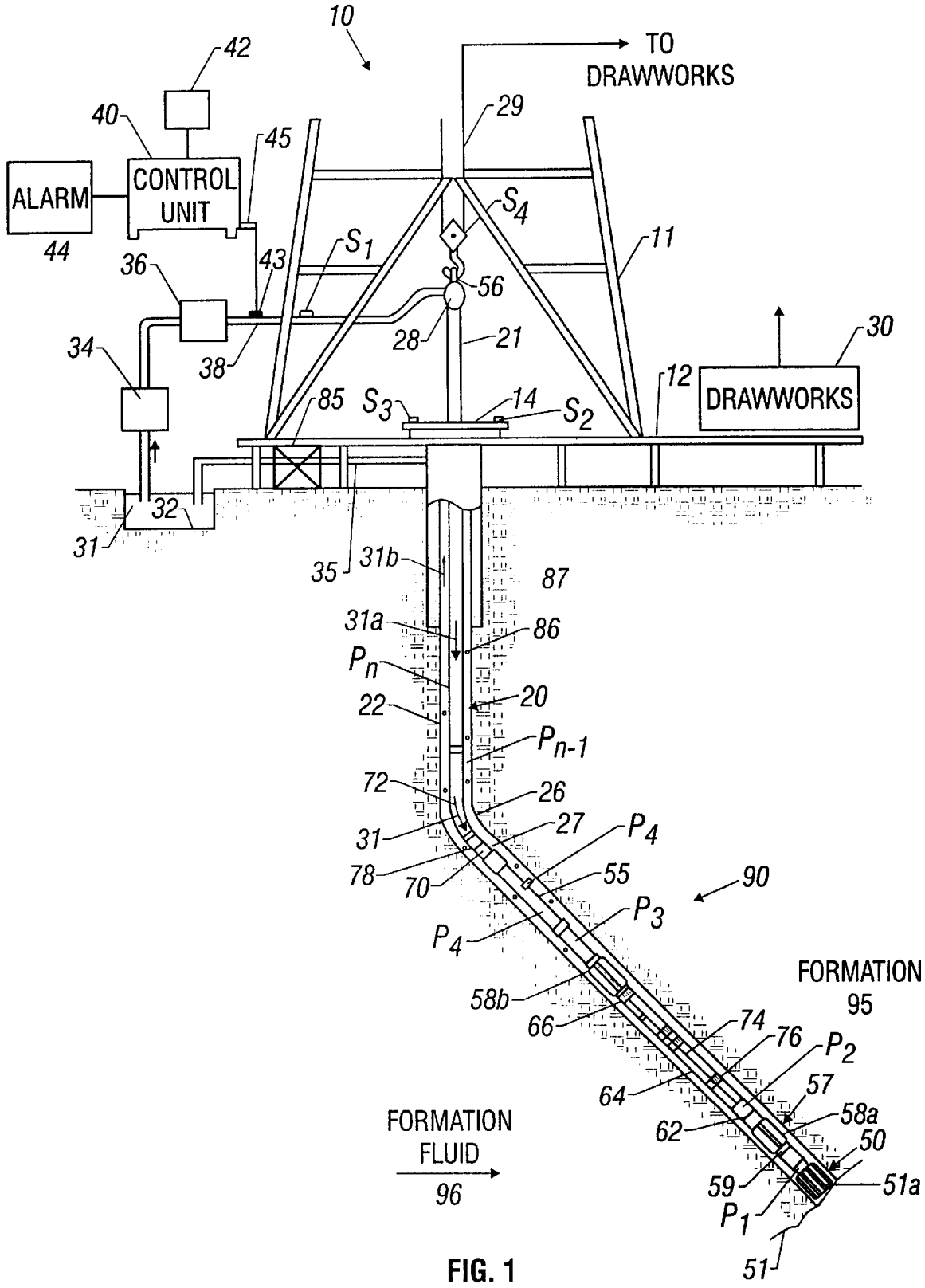
FIG. 1 shows a schematic diagram of a drilling system having a drill string containing a drill bit, mud motor, measurement-while-drilling devices, downhole processing unit and various sensors for determining properties of the drilling fluid according to one embodiment of the present invention.

FIG. 1 shows a schematic diagram of a drilling system 10 having a drilling string 20 shown conveyed in a borehole 26. The drilling system 10 includes a conventional derrick 11 erected on a platform 12 which supports a rotary table 14 that is rotated by a prime mover such as an electric motor (not shown) at a desired rotational speed. The drill string 20 includes a drill pipe 22 extending downward from the rotary table 14 into the borehole 26. A drilling assembly or borehole assembly (BHA) 90 carrying a drill bit 50 is attached to the bottom end of the drill string. The drill bit disintegrates the geological formations (rocks) when it is rotated to drill the borehole 26 producing rock bits (cuttings). The drill string 20 is coupled to a draw works 30 via a kelly joint 21, swivel 28 and line 29 through a pulley 23. During the drilling operations the draw works 30 is operated to control the weight on the bit, which is an important parameter that affects the rate of penetration. The operation of the draw works 30 is well known in the art and is thus not described in detail herein. FIG. 1 shows the use of drill pipe 22 to convey the drilling assembly 90 into the borehole 26. Alternatively, a coiled tubing with an injector head (not shown) may be utilized to convey the drilling assembly 90. For the purpose of this invention, drill pipe and coiled tubing are referred to as the "tubing". The present invention is equally applicable to both drill pipe and coiled tubing drill strings.

During drilling operations a suitable drilling fluid 31 (commonly referred to as the "mud" from a mud pit (source) 32 is supplied under pressure to the tubing 22 by a mud pump 34. The term "during drilling" herein means while drilling or when drilling is temporarily stopped for adding pipe or taking measurement without retrieving the drill string. The drilling fluid 31 passes from the mud pump 34 into the tubing 22 via a desurger 36, fluid line 38 and the kelly joint 21. The drilling fluid 31*a* travels through the tubing 22 and discharges at the borehole bottom 51 through openings in the drill bit 50. The drilling fluid 31*b* carrying drill cuttings 86 circulates uphole through the annular space (annulus) 27 between the drill string 20 and the borehole 26 and returns to the mud pit 32 via a return line 35. A shaker 85 disposed in the fluid line 35 removes the cuttings 86 from the returning fluid and discharges the clean fluid into the pit 32. A sensor $S_1$ preferably placed in the line 38, provides the rate of the fluid 31 being supplied to the tubing 22. A surface torque sensor $S_2$ and a speed sensor $S_3$ associated with the drill string 20 respectively provide measurements about the torque and the rotational speed of the drill string. Additionally, a sensor S4 associated with line 29 is used to provide the hook load of the drill string 20.

In some applications the drill bit 50 is rotated by only rotating the drill pipe 22. However, in many applications, a downhole motor or mud motor 55 is disposed in the drilling assembly 90 to rotate the drill bit 50. The drilling motor rotates when the drilling fluid 31*a* passes through the mud motor 55. The drill pipe 22 is rotated usually to supplement the rotational power supplied by the mud motor, or to effect changes in the drilling direction. In either case, the rate of penetration (ROP) of the drill bit 50 for a given formation and the type of drilling assembly used largely depends upon the weight on bit (WOB) and the drill bit rotational speed.

The embodiment of FIG. 1 shows the mud motor 55 coupled to the drill bit 50 via a drive shaft (not shown) disposed in a bearing assembly 57. The mud motor 55 transfers power to the drive shaft via one or more hollow shafts that run through the resistivity measuring device 64. The hollow shaft enables the drilling fluid to pass from the mud motor 55 to the drill bit 50. Alternatively, the mud motor 55 may be coupled below the resistivity measuring device 64 or at any other suitable place in the drill string 90. The mud motor 55 rotates the drill bit 50 when the drilling fluid 31 passes through the mud motor 55 under pressure. The bearing assembly 57 supports the radial and axial forces of the drill bit 50, the downthrust of the drill motor and the reactive upward loading from the applied weight on bit. Stabilizers 58*a* and 58*b* coupled spaced to the drilling assembly 90 acts as a centralizer for the drilling assembly 90.

A surface control unit 40 receives signals from the downhole sensors and devices (described below) via a sensor 43 placed in the fluid line 38, and signals from sensors $S_1$, $S_2$, $S_3$, hook load sensor $S_4$ and any other sensors used in the system and processes such signals according to programmed instructions provided to the surface control unit 40. The surface control unit 40 displays desired drilling parameters and other information on a display/monitor 42, which information is utilized by an operator to control the drilling operations. The surface control unit 40 contains a computer, memory for storing data, recorder for recording data and other peripherals. The surface control unit 40 also includes models or programs, processes data according to programmed instructions and responds to user commands entered through a suitable device. The control unit 40 is preferably adapted to activate alarms 44 when certain unsafe or undesirable operating conditions occur.

Still referring to FIG. 1, the drilling assembly 90 contains sensors and devices which are generally used for drilling modern boreholes, including formation evaluation sensors, sensors for determining borehole properties, tool health and drilling direction. Such sensors are often referred to in the art as the measurement-while-drilling devices or sensors. The drilling system 10 further includes a variety of sensors and devices for determining the drilling fluid 31 properties and condition of the drilling fluid during drilling of the wellbore 26 according to the present invention. The generally used MWD sensors will be briefly described first along with general description of downhole processor for processing sensor data and signals. The sensors used for determining the various properties or characteristics of the drilling or wellbore fluid are described thereafter.

The MWD sensors preferably include a device 64 for measuring the formation resistivity near and/or in front of the drill bit, a gamma ray device 76 for measuring the formation gamma ray intensity and devices 67 for determining drilling direction parameters, such as azimuth, inclination and x-y-z location of the drill bit 50. The resistivity device 64 is preferably coupled above a lower kick-off subassembly 62 and provides signals from which resistivity of the formation near or in front of the drill bit 50 is determined. The resistivity device 64 or a second resistivity device (not shown) may be is utilized to measure the resistivity of the drilling fluid 31 downhole. An inclinometer 74 and gamma the ray device 76 are suitably placed along the resistivity measuring device 64 for determining the inclination of the portion of the drill string near the drill bit 50 and the formation gamma ray intensity respectively. Any suitable inclinometer and gamma ray device, however, may be utilized for the purposes of this invention. In addition, an azimuth device, such as a magnetometer or a gyroscopic device, may be utilized to determine the drill string azimuth. A nuclear magnetic resonance (NMR) device may also be used to provide measurements for a number of formation parameters. The above-described devices are known in the art and therefore are not described in detail herein.

Still referring to FIG. 1, logging-while-drilling (LWD) devices, such as devices for measuring formation porosity, permeability and density, may be placed above the mud motor 64 in the housing 78 for providing information useful for evaluating and testing subsurface formations along borehole 26. Any commercially available devices may be utilized as the LWD devices.

The bottomhole assembly 90 includes one or more processing units 70 which preferably includes one or more processors or computers, associated memory and other circuitry for processing signals from the various downhole sensors and for generating corresponding signals and data. The processors and the associated circuit elements are generally denoted by numeral 71. Various models and algorithms to process sensor signals, and data and to compute parameters of interest, such as annulus pressure gradients, temperature gradients, physical and chemical properties of the wellbore fluid including density, viscosity, clarity, resistivity and solids content are stored in the downhole memory for use by the processor 70. The models, are also be provided to the surface control unit 40. A two-way telemetry 72 provides two-way communication of signals and data between the downhole processing units 70 and the surface control unit 40. Any telemetry system, including mud pulse, acoustic, electromagnetic or any other known telemetry system may be utilized in the system 10 of this invention. The processing units 70 is adapted to transmit parameters of interest, data and command signals to the surface control unit 40 and to receive data and command signals from the surface control unit 40.

As noted above, the drilling system 10 of this invention includes sensors for determining various properties of the drilling fluid, including physical and chemical properties, chemical composition and temperature and pressure distribution along the wellbore 26. Such sensors and their uses according to the present invention will now be described.

Figure 2A:
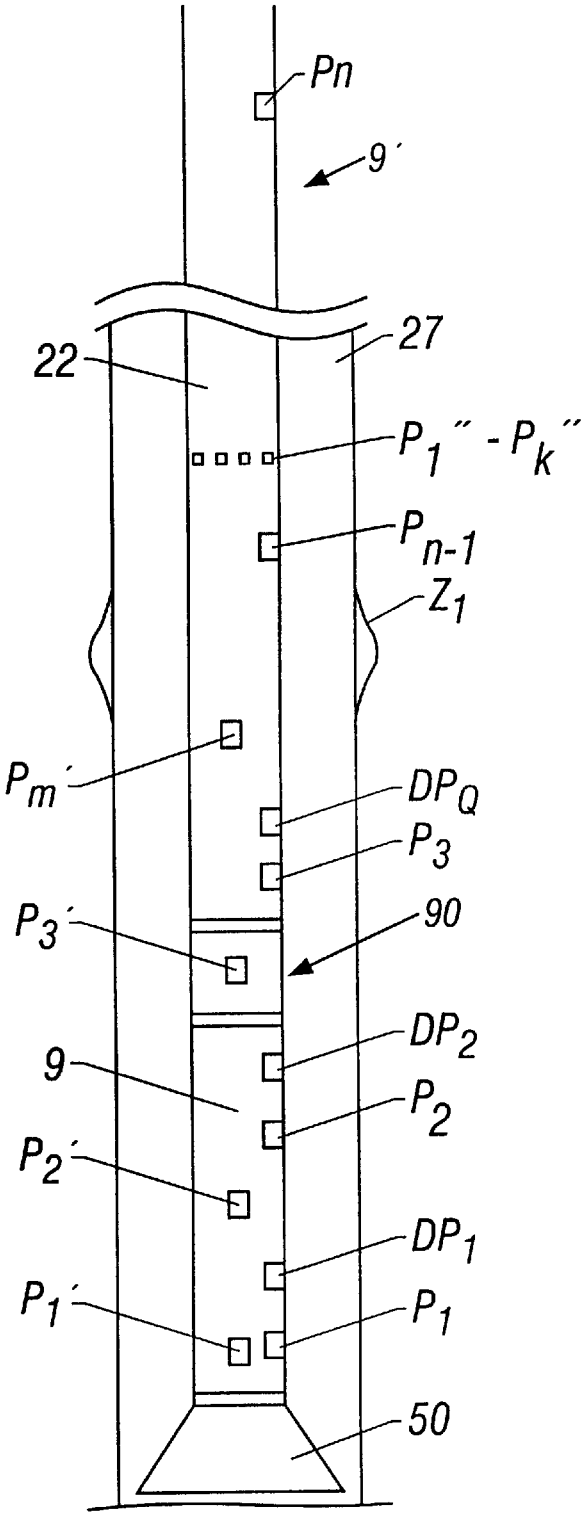
FIG. 2A shows a schematic diagram of a drilling assembly with a plurality of pressure sensors and differential pressure sensors according to the present invention.

FIGS. 1 and 2A show the placement of pressure sensors and differential pressure sensors according to one embodiment of the drill string 20. Referring to these figures, a plurality of pressure sensors $P_1$–$P_n$ are disposed at selected locations on the drill string 20 to determine the pressure of the fluid flowing through the drill string 20 and the annulus 27 at various locations. A pressure sensor $P_1$ is placed near the drill bit 50 to continuously monitor the pressure of the fluid leaving the drill bit 50. Another pressure sensor $P_n$ is disposed to determine the annulus pressure a short distance below the upper casing 87. Other pressure sensors $P_2$–$P_{n-1}$ are distributed at selected locations along the drill string 20. Also, pressure sensors $P_1'$–$P_m'$ are selectively placed within the drill string 20 to provide pressure measurements of the drilling fluid flowing through the tubing 22 and the drilling assembly 90 at such selected locations. Additionally, differential pressure sensors $DP_1$–$DP_q$ disposed on the drill string provide continuous measurements of the pressure difference between the fluid in the annulus 27 and the drill string 20. Pressure sensors $P_1''$–$P_k''$ may be disposed azimuthally at one or more locations to determine the pressure circumferentially at selected locations on the drill string 20. The azimuthal pressure profile can provide useful information about accumulation of cuttings along a particular side of the drill string 20.

Control of formation pressure is one of the primary functions of the drilling fluids. The hydrostatic pressure exerted by the fluid 31*a* and 31*b* column is the primary method of controlling the pressure of the formation 95. Whenever the formation pressure exceeds the pressure exerted on the formation 95 by the drilling fluid at a given, formation fluids 96 enter the wellbore, causing a "kick." A kick is defined as any unscheduled entry of formation fluids into the wellbore. Early detection of kicks and prompt initiation of control procedures are keys to successful well control. If kicks are not detected early enough or controlled properly when detected, a blowout can occur. One method of detecting kicks according to the present invention is by monitoring the pressure gradient in the wellbore. The distributed pressure sensor $P_1$–$P_n$ and $P_1'$–$P_m'$ shown in FIGS. 1 and 2A provide the pressure gradient along the drill string or wellbore. Any sudden or step change in pressure between adjacent pressure sensors $P_1$–$P_n$ when correlated with other parameters, such as mud weight and geological information can provide an indication of the kick. Monitoring of the wellbore pressure gradient can provide relative early indication of the presence of kicks and their locations or depths. Corrective action, such as changing the drilling fluid density, activating appropriate safety devices, and shutting down the drilling, if appropriate, can be taken. In one embodiment the downhole processing unit 70 processes the pressure sensor signals and determines if a kick is present and its corresponding well depth and transmits signals indicative of such parameters to the control unit 40 at the surface. The surface unit 40 may be programmed to display such parameters, activate appropriate alarms and/or cause the wellbore 26 to shut down.

Pressure sensors $P_1'$–$P_{n'}$ determine the pressure profile of the drilling fluid 31*a* flowing inside the drill string 20. Comparison of the annulus pressure and the pressure inside the drill sting provides useful information about pressure anomalies in the wellbore 26 and an indication of the performance of the drilling motor 55. The differential pressure sensors $DP_1$–$DP_q$ provide continuous information about the difference in pressure of the drilling fluid in the drill string 22 and the annulus 27.

Figure 2B:
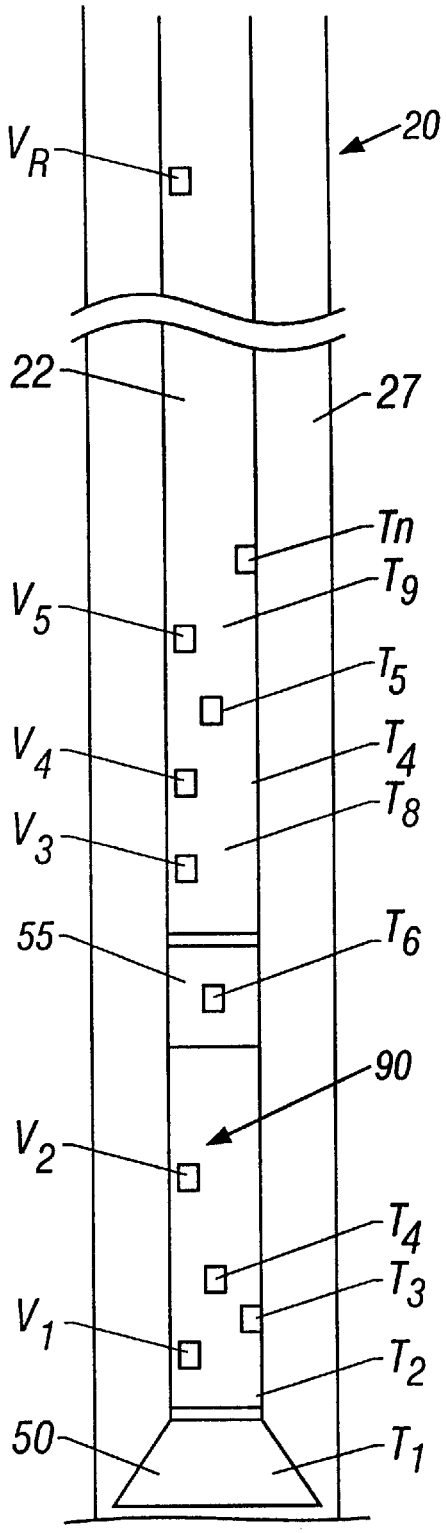
FIG. 2B shows a schematic diagram of a drilling assembly with a plurality of temperature sensors according to one embodiment of the present invention.

FIGS. 1 and 2B show the placement of temperature sensors in one embodiment of the drill string 20. Referring to these figures, a plurality of temperature sensors $T_1$–$T_j$ are placed at selected location in the drill string. One or more temperature sensors such as sensor $T_1$ are placed in the drill bit 50 to monitor the temperature of the drill bit and the drilling fluid near the drill bit. A temperature sensor $T_2$ placed within the drill string 20 above the drill bit 50 provides information about the temperature of the drilling fluid 31*a* entering the drill bit 50. The difference in temperature between $T_1$ and $T_2$ is an indication of the performance of the drill bit 50 and the drilling fluid 31. A large temperature difference may be due to one or more of: a relatively low fluid flow rate, drilling fluid composition, drill bit wear, weight on bit and drill bit rotational speed. The control unit 70 transmits the temperature difference information to the surface for the operator to take corrective actions. The corrective action may include increasing the drilling fluid flow rate, speed, reducing the drill bit rotational speed, reducing the weight or force on bit, changing the mud composition and/or replacing the drill bit 50. The rate of penetration (ROP) is also continuously monitored, which is taken into effect prior to taking the above described corrective actions.

Temperature sensors $T_2$–$T_k$ provide temperature profile or gradient of the fluid temperature in the drill string and in the annulus 27. This temperature gradient provides information regarding the effect of drilling and formations on the wellbore fluid thermal properties of the capacity of the particular drilling fluid is determined from these temperature measurements. The pressure gradient determined from the distributed pressure sensors (see FIG. 2A) and the temperature gradient described with respect to FIG. 2B can be used to perform reservoir modeling during drilling of the wellbore. Reservoir modeling provides maps or information about the location and availability of hydrocarbons within a formation or field. Initial reservoir models are made from seismic data prior to drilling wellbores in a field, which are updated after the wellbore has been drilled and during production. The present invention, however, provides an apparatus and method for updating the reservoir models during drilling of the wellbores from the availability of the pressure and temperature gradients or profiles of the wellbore during drilling. The reservoir modeling is preferably done at the surface and the results may be utilized to alter drilling direction or other drilling parameters as required.

One or more temperature sensors such as sensor $T_6$, placed in the drilling motor 55, determine the temperature of the drilling motor. Temperature sensors such as sensors $T_7$–$T_9$ disposed within the drill string 20 provide temperature profile of the drilling fluid passing through the drilling assembly and the mud motor 55. The above-noted temperature measurement can be used with other measurement and knowledge of the geological or rock formations to optimize drilling operations. Predetermined temperature limits are preferably stored in the memory of the processor 70 and if such values are exceeded, the processor 70 alerts the operator or causes the surface control unit 40 to take corrective actions, including shutting down the drilling operation.

In prior art, mud mix is designed based on surface calculations which generally make certain assumptions about the downhole conditions including estimates of temperature and pressure downhole. In the present invention, the mud mix may be designed based on in-situ downhole conditions, including temperature and pressure values.

Still referring to FIGS. 1 and 2B, a plurality of flow rate sensors $V_1$–$V_r$ are disposed in the drill string 20 to determine the fluid flow rate at selected locations in the drill string 20 and in the annulus 27. Great differences in the flow rate between the high side and the low side of the drill string provides at least qualitative measure and the location of the accumulation of cuttings and the locations where relatively large amounts of the drilling fluid are penetrating in the formation.

The above described pressure sensors, temperature sensors and flow rate sensors may be arrayed on an optic fiber and disposed over a great length of the drill string, thus providing a relatively large number of distributed fiber optic sensors along the drill string. A light source at the surface or downhole can provide the light energy. Fiber optic sensors offer a relatively inexpensive way of deploying a large number of sensors to determine the desired pressure, temperature, flow rate and acoustic measurements.

During drilling of wellbores, it is useful to determine physical properties of the drilling fluid. Such properties include density, viscosity, lubricating compressibility, clarity, solids content and rheology. Prior art methods usually employ testing and analysis of fluid samples taken from the wellbore fluid returning to the surface. Such methods do not provide in-situ measurements downhole during the drilling process and may not provide accurate measurement of the corresponding downhole values. The present invention provides devices and sensors for determining such parameters downhole during drilling of the wellbores.

Figure 3:
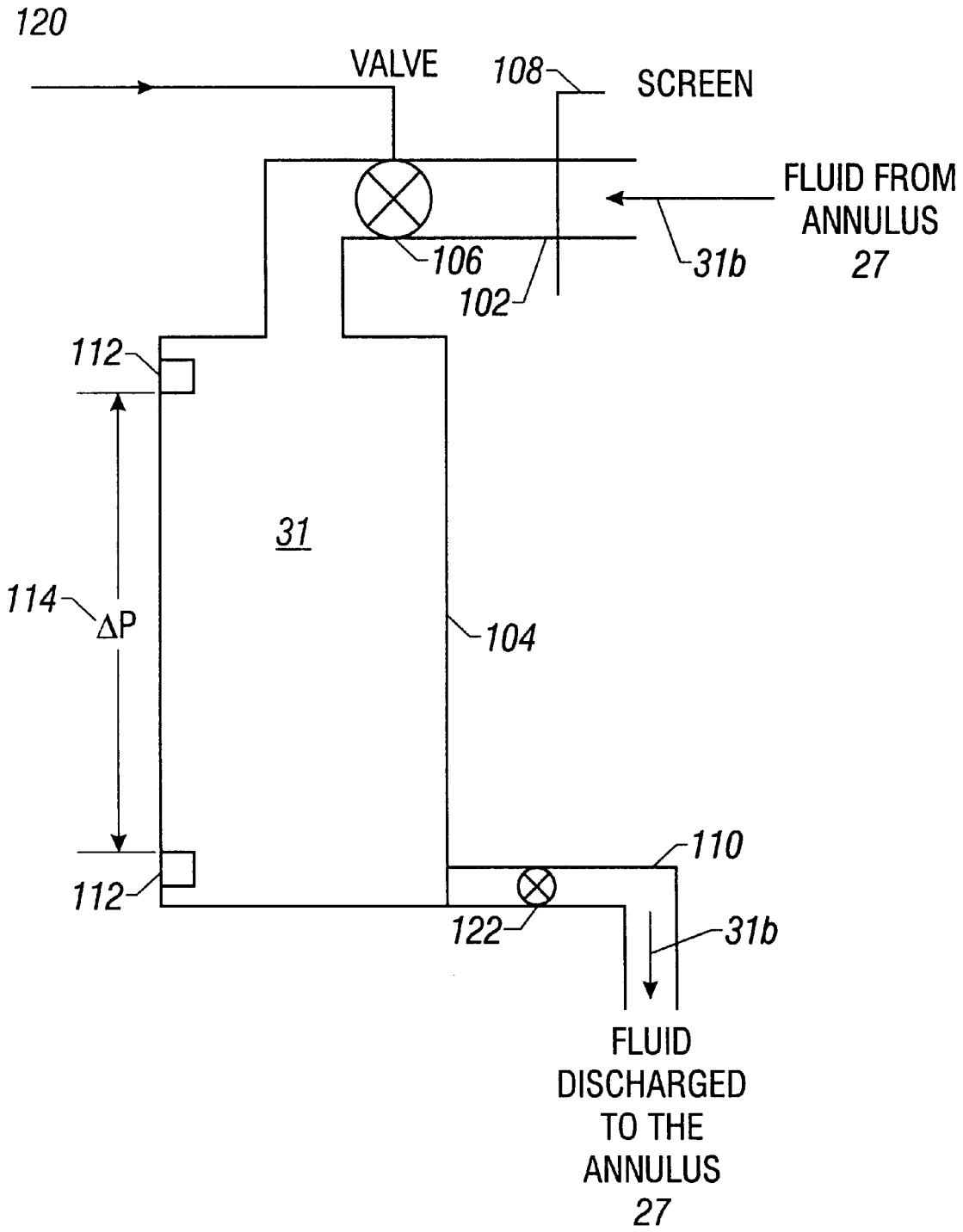
FIG. 3 shows a schematic diagram of a sensor for determining the density of the drilling fluid.

The density of the fluid entering the drill string 20 and that of the returning fluid is generally determined at the surface. The present invention provides methods of determining the fluid density downhole. Referring to FIGS. 1 and 3, in one method, the drilling fluid 31 is passed into a chamber or a line 104 via a tubing 102 that contains a screen 108, which filters the drill cuttings 86. A differential pressure sensor 112 determines the difference in pressure 114 (Dt) due to the fluid column in the chamber, which provides the density of the fluid 31. A downhole-operated control valve 120 controls the inflow of the drilling fluid 31 into the chamber 104. A control valve 122 is used to control the discharge of the fluid 31 into the annulus 27. The downhole processor 70 controls the operation of the valves 120 and 122 and preferably processes signals from the sensor 112 to determine the fluid density. The density may be determined by the surface unit 40 from the sensor 112 signals transmitted to the surface. If the downhole fluid density differs from the desired or surface estimated or computed downhole density, then mud mix is changed to achieve the desired downhole density. Alternatively, unfiltered fluid may also be utilized to determine the density of the fluid in the annulus 27. Other sensors, including sonic sensors, may also be utilized to determine the fluid density downhole without retrieving samples to the surface during the drilling process. Spaced apart density sensors can provide density profile of the drilling fluid in the wellbore.

Downhole measurements of the drilling fluid density provide accurate measure of the effectiveness of the drilling fluid. From the density measurements, among other things, it can be determined (a) whether cuttings are effectively being transported to the surface, (b) whether there is barite sag, i.e., barite is falling out of the drilling fluid, and (c) whether there is gas contamination or solids contamination. Downhole fluid density measurements provide substantially online information to the driller to take the necessary corrective actions, such as changing the fluid density, fluid flow rate, types of additives required, etc.

Figure 4:
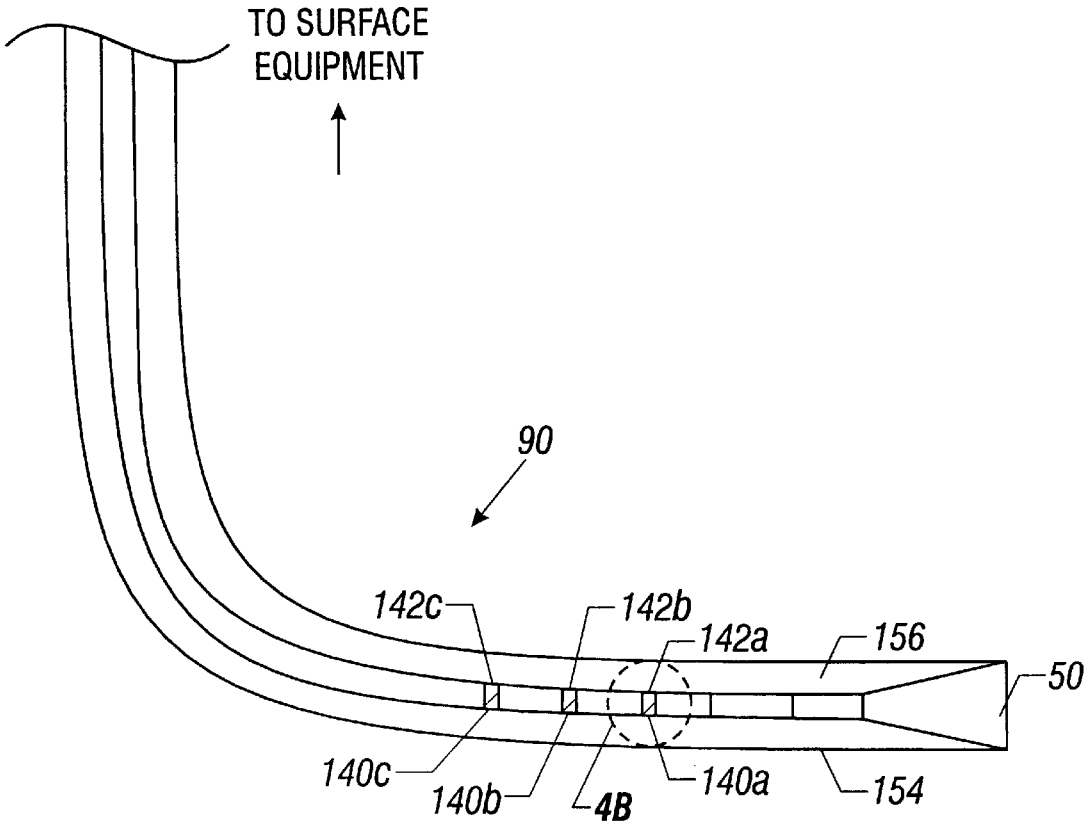
FIG. 4 shows a schematic of a drill string with a plurality of acoustic devices for determining selected properties of drilling fluid according to the present invention.
Figure 4A:
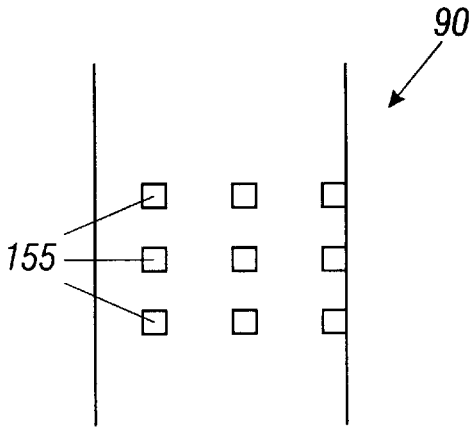
FIG. 4A shows an arrangement of a plurality of acoustic sensor elements for use in the acoustic systems shown in FIG. 4.

FIG. 4 shows an ultrasonic sensor system that may be utilized to determine the amount of cuttings present in the annulus and the borehole size. Referring to FIGS. 1 and 4, as an example, the drill string 20 is shown to contain three spaced apart acoustic sensor arrangements 140*a*–140*c*. Each of the acoustic sensor arrangements contains one or more transmitters which transmit sonic signals at a predetermined frequency which is selected based on the desired depth of investigation. For determining the relative amount of the solids in the drilling fluid, the depth of investigation may be limited to the average borehole 27 diameter size depicted by numerals 142*a*–142*c*. Each sensor arrangement also includes one or more receivers to detect acoustic signals reflecting from the solids in the drilling fluid 31. The same sensor element may be used both as a transmitter and receiver. Depending upon the axial coverage desired, a plurality of sensor elements may be arranged around the drilling assembly. One such arrangement or configuration is shown in FIG. 4A, wherein a plurality of sensor elements 155 are symmetrically arranged around a selected section of the drilling assembly 90. Each element 155 may act as a transmitter and a receiver. Such ultrasonic sensor arrangements are known in the art and are, thus, not described in detail herein.

Figure 4B:
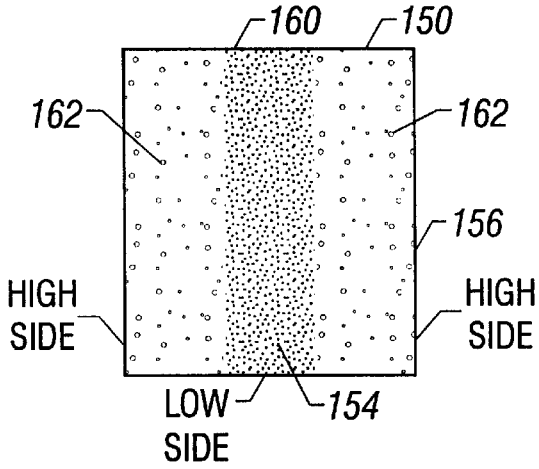
FIG. 4B shows a display of the fluid characteristics obtained by an acoustic device of the system of FIG. 4.

During drilling of the wellbore (i.e. when drilling is in progress or when drilling is temporarily stopped to take measurements), signals from each of the sensor arrangements 140*a*–140*c* are processed by the downhole processor 70 to provide images of the fluid volumes 142*a*–142*c* in the annulus 27. FIG. 4B shows an example of a radial image in a flat form that may be provided by the sensor arrangement 140*a*. The image 150, if rolled end to end at low sides 154 will be the image of volume 142*a* surrounding the sensor arrangement 140*a*. Image 150 shows a cluster 160 of sonic reflections at the low side 156, indicating a large number of solids (generally cuttings) accumulating on the low side 154 and relatively few reflections 162 at the high side 156, indicating that cuttings are flowing adequately along the high side 156 of the borehole 27. This method provides a visual indication of the presence of solids surrounding an area of investigation around each sensor 140*a*–140*c*. Spaced apart sensors 140*a*–140*c* provide such information over an extended portion of the drill string and can point to local accumulation areas. Corrective action, such as increasing the flow rate, hole cleaning, and bit replacement can then be taken. By varying the frequency of transmission, depth of investigation can be varied to determine the borehole size and other boundary conditions.

Figure 5:
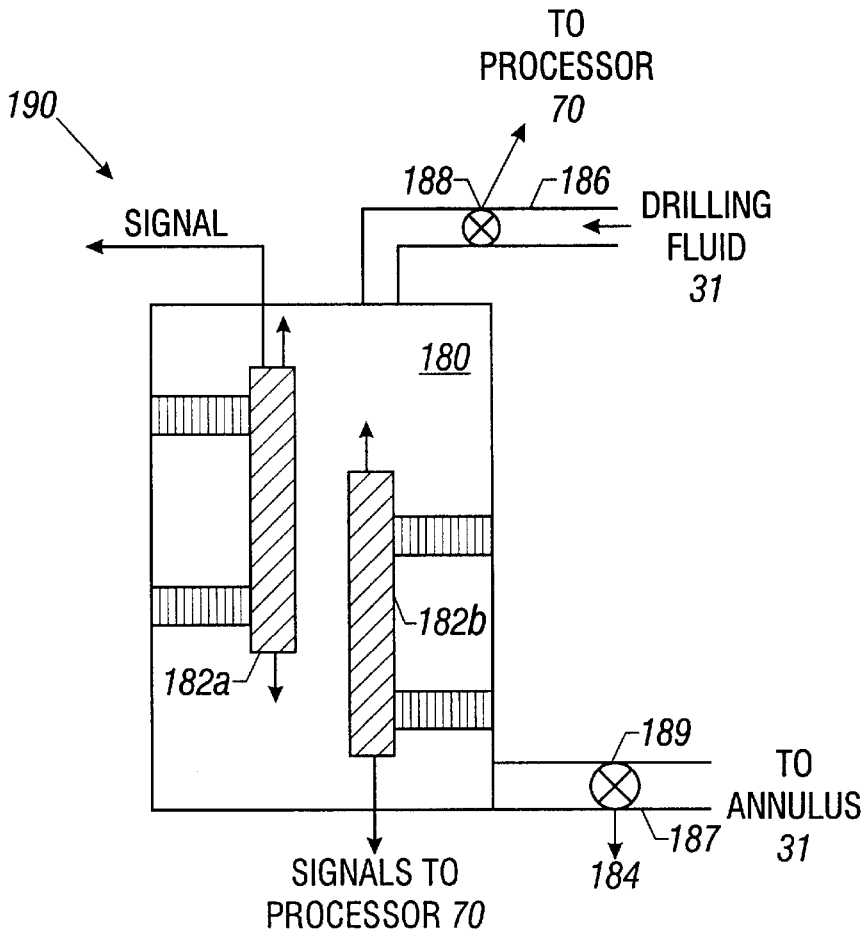
FIG. 5 shows a schematic diagram of a sensor for determining the viscosity of the drilling fluid.

FIG. 5 shows a device 190 for use in the drilling assembly for determining viscosity of the drilling fluid downhole. The device contains a chamber 180, which includes two members 182*a* and 182*b*, at least one of which moves relative to the other. The members 182*a* and 182*b* preferably are in the form of plates facing each other with a small gap 184 therebetween. Filtered drilling fluid from 31 from the annulus 27 enters the chamber 180 via an inlet line 186 when the control valve 188 is opened. The gap 184 is filled with the drilling fluid 31. The members 182*a* and 182*b* are moved to determine the friction generated by the drilling fluid relative to a known reference value, which provides a measure of the viscosity of the drilling fluid. The members 182*a* and 182*b* may be operated by a hydraulic device, an electrical device or any other device (not shown) and controlled by the downhole processor 70. In one embodiment, the signals generated by the device 190 are processed by the processor 70 to provide viscosity of the drilling fluid. Fluid from the chamber 180 is discharged into the wellbore 26 via line 187 by opening the control valve 189. The control valves 188 and 189 are controlled by the processor 70. Alternatively, any other suitable device may be utilized to determine the viscosity of the drilling fluid downhole. For example a rotating viscometer (known in the art) may be adapted for use in the drill string 20 or an ultrasonic (acoustic) device may be utilized to determine the viscosity downhole. Since direct measurements of the downhole pressure and temperature are available at or near the sample location, the viscosity and density of the drilling fluid are calculated as a function of such parameters in the present invention. It should be obvious that the signals from the sensor 190 may be transmitted to the surface and processed by the surface processor 40 to determine the viscosity.

Figure 6:
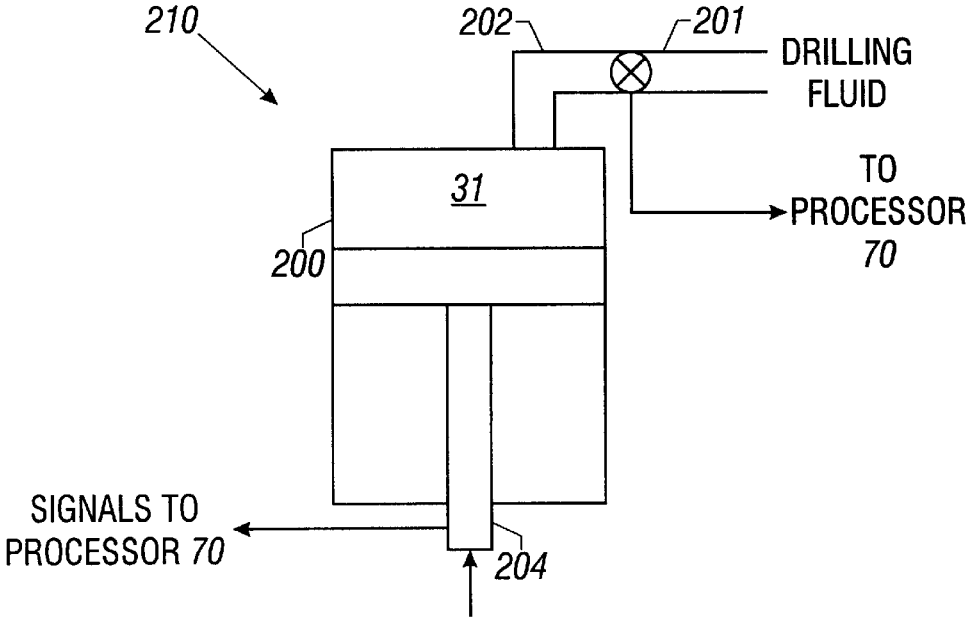
FIG. 6 shows a schematic diagram of a sensor for determining the compressibility of the drilling fluid.

The device 190 may be reconfigured or modified wherein the members 182*a* and 182*b* rub against each other. In such a configuration, the friction can represent the lubricity of the drilling fluid. The signals are processed as described Fluid compressibility of the wellbore fluid is another parameter that is often useful in determining the condition and the presence of gas present in the drilling fluid. FIG. 6 shows a device 210 for use in the BHA for determining compressibility of the drilling fluid downhole. Drilling fluid 31 is drawn into an air tight cylinder 200 via a tubing 201 by opening a valve 202 and moving the piston 204. The fluid 31 is drawn into the chamber 200 at a controlled rate to preserve the fluid characteristics as they exist in the annulus 27. To determine the compressibility of the drilling fluid 31, the piston 204 is moved inward while the control valve 202 is closed. The reduction in fluid volume is determined from the travel distance of the piston. Movement of the piston 202 may be controlled electrically by a motor or by an hydraulic or a pneumatic pressure. The operation of the device 210 (control valve 201 and the piston 204) is controlled by the processor 70 (see FIG. 1). The processor 70 receives signals from the device 210 corresponding to the piston travel and computes therefrom compressibility of the fluid 31. It should be noted that for the purposes of this invention any other suitable device may be utilized for determining compressibility of the drilling fluid downhole. The compressibility herein is determined under actual downhole conditions compared to compressibility determined on the surface, which tends to simulate the downhole conditions.

Compressibility for water, oil, and gas (hydrocarbon) is different. For example downhole compressibility measurements can indicate whether gas or air is present. If it is determined that air is present, defoamers can be added to the drilling fluid 31 supplied to wellbore. Presence of gas may indicate kicks. Other gases that may be present are acidic gases such as carbon dioxide and hydrogen sulphide. A model can be provided to the downhole processor 70 to compute the compressibility and the presence of gases. The computed results are transmitted to the surface via telemetry 72. Corrective actions are then taken based on the computed values. The compressibility also affects performance of the mud motor 55. Compressible fluid passing through the drilling motor 55 is less effective than non-compressible fluids. Maintaining the drilling fluid free from gases allows operating the mud motor at higher efficiency. Thus, altering compressibility can improve the drilling rate.

Figure 7:
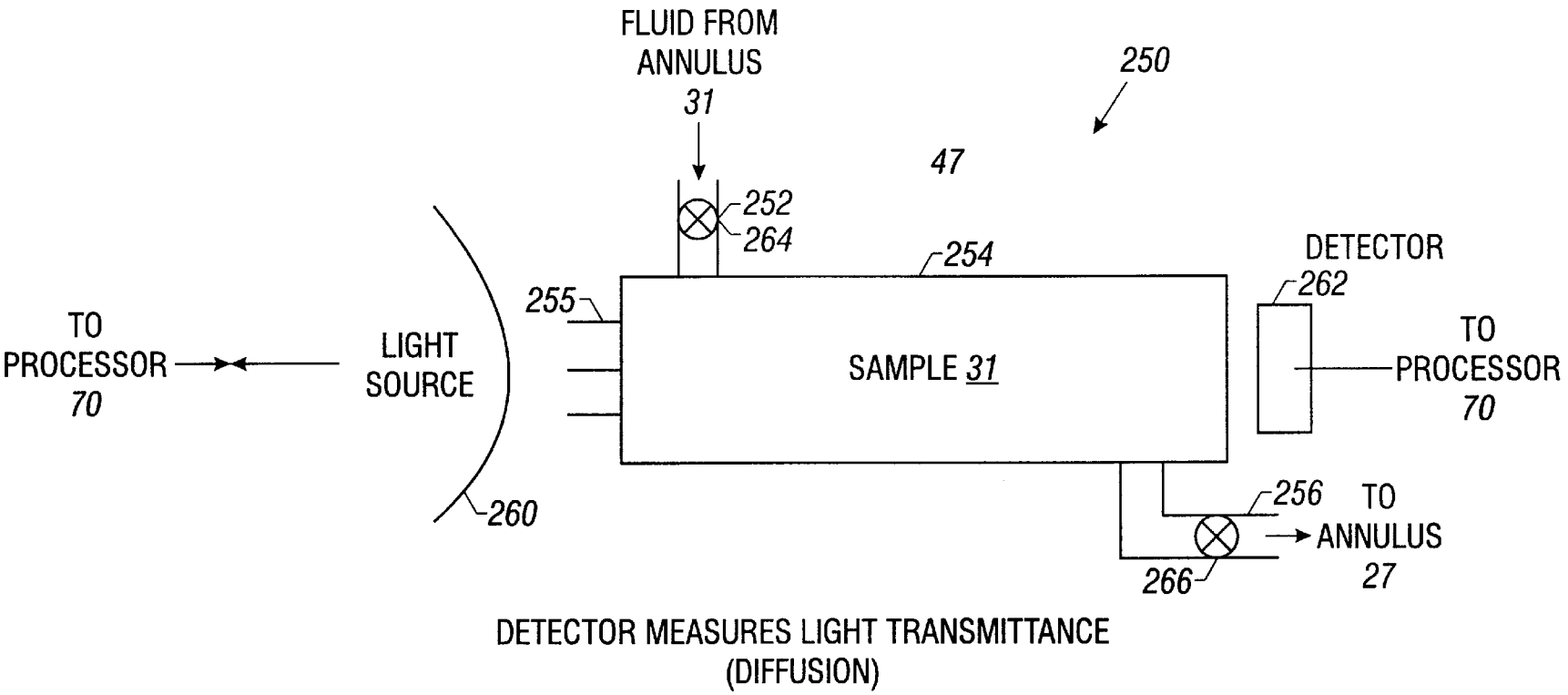
FIG. 7 shows a schematic diagram of a sensor for determining the clarity of the drilling fluid.

As noted above, clarity of drilling fluid in the annulus can provide useful information about the drilling process. FIG. 7 shows a device 250 for use in the drilling assembly for in-situ determination of clarity of the drilling fluid during the drilling of the wellbore. The device 250 contains a chamber 254 through which a sample of the drilling fluid is passed by opening an inlet valve 264 and closing an outlet valve 266. Drilling fluid 31 may be stored in the chamber 254 by closing the valve 266 or may be allowed to flow through by opening both valves 264 and 266. A light source 260 at one end 257 of the chamber 254 transmits light into the chamber 254. A detector 262 at an opposite end 257 detects the amount of light received through the fluid 31 or in the alternative the amount of light dispersed by the fluid 31. Since the amount of light supplied by the source 260 is known, the detector provides a measure of the relative clarity of the drilling fluid 31. The portions of the ends 255 and 257 that are used for transmitting or detecting the light are transparent while the remaining outside areas of the chamber 254 are opaque.

The downhole processor 70 (FIG. 1) controls the operation of the light source 260, receives signals from the detector 262 and computes the clarity value based on models or programmed instructions provided to the processor 70. The clarity values may be determined continuously by allowing the drilling fluid 31 to flow continuously through the chamber or periodically. Inferences respecting the types of cuttings, solid content and formation being drilled can be made from the clarity values. The clarity values are transmitted uphole via telemetry 72 (FIG. 1) for display and for the driller to take necessary corrective actions.

The drilling assembly 90 also may include sensors for determining certain other properties of the drilling fluid. For example a device for determining the pH of the drilling fluid may be installed in the bottomhole assembly. Any commercially available device may be utilized for the purpose of this invention. Value of pH of the drilling fluid provides a measure of gas influx or water influx. Water influx can deteriorate the performance of oil based drilling fluids.

Chemical properties, such as presence of gas (methane), hydrogen sulphide, carbon dioxide, and oxygen of the drilling fluid are measured at the surface from drilling fluid samples collected during the drilling process. However, in many instances it is more desirable to determine such chemical properties of the drilling fluid downhole.

In one embodiment of this invention, application specific fiber optic sensors are utilized to determine various chemical properties. The sensor element is made of a porous glass having an additive specific to measuring the desired chemical property of the drilling fluid. Such porous glass material is referred to as sol-gel. The sol-gel method produces a highly porous glass. Desired additives are stirred into the glass during the sol-gel process. It is known that some chemicals have no color and, thus, do not lend themselves to analysis by standard optical techniques. But there are substances that will react with these colorless chemicals and produce a particular color, which can be detected by the fiber optic sensor system. The sol-gel matrix is porous, and the size of the pores is determined by how the glass is prepared. The sol-gel process can be controlled to create a sol-gel indicator composite with pores small enough to trap an indicator in the matrix and large enough to allow ions of a particular chemical of interest to pass freely in and out and react with the indicator. Such a composite is called a sol-gel indicator. A sol-gel indicator can be coated on a probe which may be made from steel or other base materials suitable for downhole applications. Also, sol gel indicator have a relatively quick response time. The indicators are small and rugged and thus suitable for borehole applications. The sol-gel indicator may be calibrated at the surface and it tends to remain calibrated during downhole use. Compared to a sol-gel indicator, other types of measuring devices, such as a pH meter, require frequent calibrations. Sol-gel indicators tend to be self-referencing. Therefore, reference and sample measurements may be taken utilizing the same probe.

Figure 8:
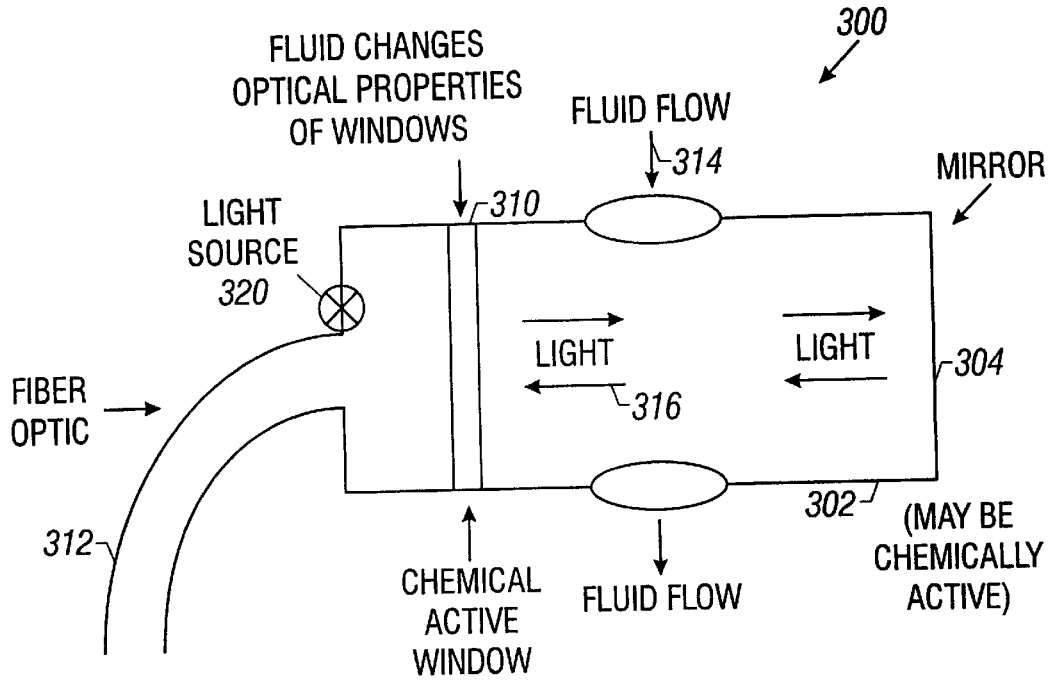
FIG. 8 shows a schematic diagram of a fiber optic sensor for determining certain chemical properties of the drilling fluid.

FIG. 8 shows a schematic diagram of an embodiment of a fiber-optic device 300 with a sol-gel indicator 310. The sensor 300 contains the sol-gel indicator or member 310 and a fluid path 314 that provides the drilling fluid to the member 310. Light 316 is supplied from a source 320 via a fiber-optic cable 312 to the sol-gel to member 310. The light 316 travels past the member 310 and is reflected back form a light mirror 304 at the end opposite to the light source 320. Light 316 reflected back to the cable 312 is detected and processed by the downhole processor 70 (FIG. 1). The sol-gel member 310 will change color when it comes in contact with the particular chemical for which it is designed. Otherwise, the color will remain substantially unchanged. Therefore, the additive in the sol-gel member is chosen for detecting a particular chemical in the drilling fluid 31. In the preferred embodiment, a sensor each for detecting methane (gas), hydrogen sulphide and pH are disposed at suitable locations in the drill string. More than one such sensors may be distributed along the drill string. Sensors for detecting other chemical properties of the drilling fluid may also be utilized.

Figure 9:
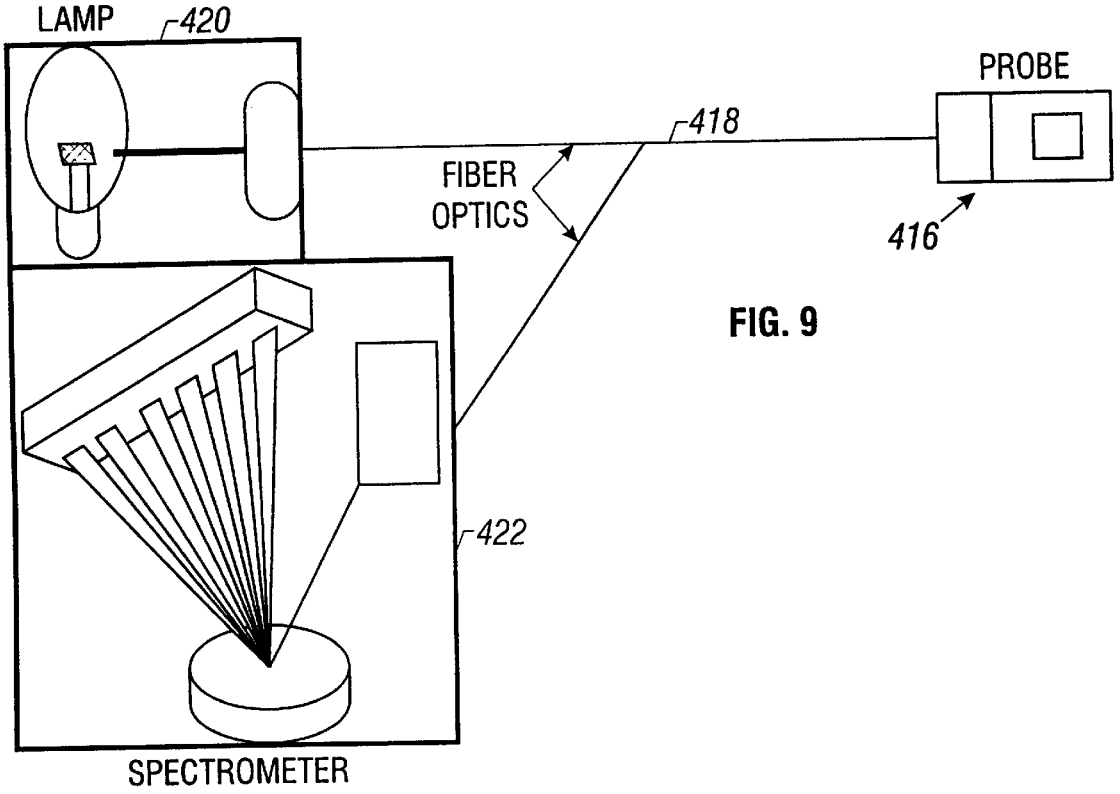
FIG. 9 is a schematic illustration of a fiber optic sensor system for monitoring chemical properties of produced fluids.
Figure 10:
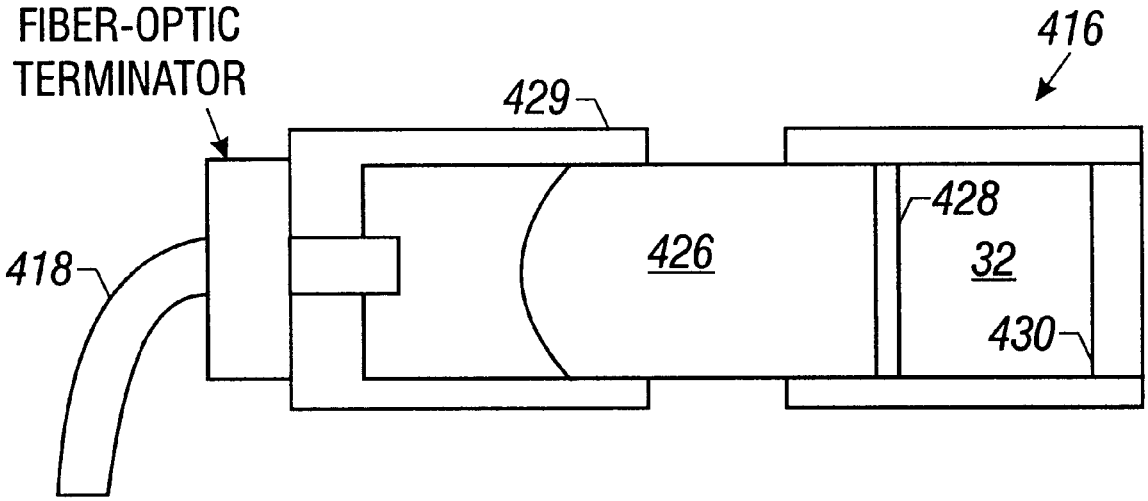
FIG. 10 is a schematic illustration of a fiber optic sol gel indicator probe for use with the sensor system of FIG. 9.

FIGS. 9 and 10 show an alternative configuration for the sol-gel fiber optic sensor arrangement. A probe is shown at 416 connected to a fiber optic cable 418 which is in turn connected both to a light source 420 and a spectrometer 422. As shown in FIG. 10, probe 416 includes a sensor housing 424 connected to a lens 426. Lens 426 has a sol gel coating 428 thereon which is tailored to measure a specific downhole parameter such as pH or is selected to detect the presence, absence or amount of a particular chemical such as oxygen, $H_2S$ or the like. Attached to and spaced from lens 426 is a mirror 430. During use, light from the fiber optic cable 418 is collimated by lens 426 whereupon the light passes through the sol gel coating 428 and sample space 432. The light is then reflected by mirror 430 and returned to the fiber optical cable. Light transmitted by the fiber optic cable is measured by the spectrometer 422. Spectrometer 422 (as well as light source 420) may be located either at the surface or at some location downhole. Based on the spectrometer measurements, a control computer 414, 416 will analyze the measurement and based on this analysis, the chemical injection apparatus 408 will change the amount (dosage and concentration), rate or type of chemical being injected downhole into the well. Information from the chemical injection apparatus relating to amount of chemical left in storage, chemical quality level and the like will also be sent to the control computers. The control computer may also base its control decision on input received from surface sensor 415 relating to the effectiveness of the chemical treatment on the produced fluid, the presence and concentration of any impurities or undesired by-products and the like. As noted above, the bottomhole sensors 410 may be distributed along the drill string 20 for monitoring the chemical content of the wellbore fluid as it travels up the wellbore at any number of locations.

Alternatively a spectrometer may be utilized to monitor certain properties of downhole fluids. The sensor includes a glass or quartz probe, one end or tip of which is placed in contact with the fluid. Light supplied to the probe is refracted based on the properties of the fluid. Spectral analysis of the refracted light is used to determine and monitor the properties of the wellbore fluid, which include the water, gas, oil and solid contents and the density.

It is known that infrared and near infrared light spectra can produce distinct peaks for different types of chemicals in a fluid. In one embodiment of the present invention a spectroscopy device utilizing infrared or near infrared technique is utilized to detect the presence of certain chemicals, such as methane. The device contains a chamber which houses a fluid sample. Light passing through the fluid sample is detected and processed to determine the presence of the desired chemical.

Figure 11:
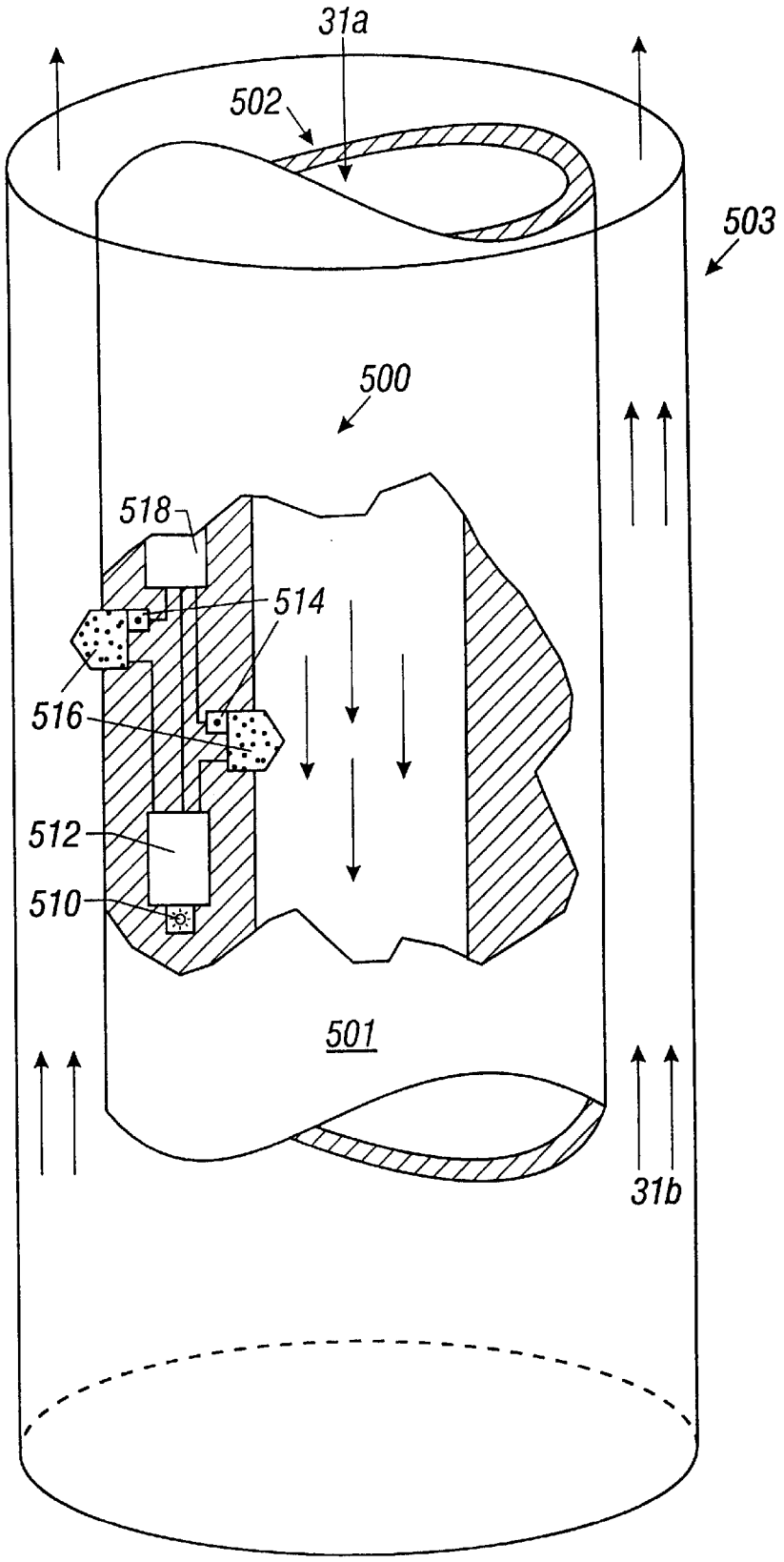
FIG. 11 is a schematic illustration of an embodiment of an infrared sensor carried by the bottomhole assembly for determining properties of the wellbore fluid.

FIG. 11 is a schematic illustration of an embodiment of an infrared sensor carried by the bottomhole assembly for determining properties of the wellbore fluid. The infrared device 500 is carried by a suitable section 501 of the drill string 502. The drilling fluid 31*a* supplied from the surface passes through the drill string interior to the bottom of the borehole 502. The wellbore fluid 31*b* returning to the surface contains the drill cuttings and may contain the formation fluids. The optical sensing device 500 includes a broadband light source 510 (e.g. an incandescent lamp), an acousto-optical tunable filter (AOTF) based monochromator 512, one or more optical detectors 514 to detect the reflected radiation and one or more total reflectance (TR) crystal coupled to the monochromator 512 and the detectors 514 by optical fibers.

The monochromatic radiation with a wavelength defined by the monochromator 512 enters the TR crystal(s) 516 and is reflected by its surface which interfaces the high-pressure drilling fluid 316. Due to specific absorption properties the reflected radiation is attenuated at specified wavelengths which are characteristic for the analytes to be determined and evaluated. The reflected radiation intensity is measured by the detector(s) 514 which are connected to an onboard computer or processor 518, which serves for data acquisition, spectra analysis, and control of the AOTF proper operation (by means of a reference detector inside the monochromator). The more sophisticated analysis scheme includes one TR crystal mounted in a housing on the outside of the drilling tube and a second TR crystal mounted in a housing on the inside surface of the drilling tube. This configuration makes it possible to obtain the pure spectrum of the gas or liquid which is infused from the formation being drilled by subtracting the spectrum of the drilling liquid inside the tube from the spectrum of the liquid in the borehole outside the tube, which is a mixture of the drilling liquid with the influx from the formation. This method also is used to determine the weight or volume percent of analytes in the wellbore fluid.

In operation, broadband radiation from the light source enters the monochromator, where the AOTF (an acousto-optic crystal tuned by RF generator) selects narrow-width spectral bands at specified wavelengths which are characteristic for the chemical compounds to be determined and evaluated. This monochromatic radiation is delivered to one of at least two TR crystals, which are mounted in pockets on the interior and the exterior walls the drilling assembly by optical fibers.

The monochromatic radiation with a wavelength defined by the monochromator enters the TR crystal and it is internally reflected by the surface, which interfaces the high-pressure drilling fluid. Due to specific absorption properties of molecules of the analytes, radiation reflected by the interface is attenuated at the specific wavelengths by the magnitude which is characteristic of the quantity of the compound molecules in the fluid. The reflected radiation is delivered to a detector(s), which, in turn, is(are) connected to an onboard computer, which serves for data acquisition, spectra analysis, and control of the AOTF proper operation (by means of a reference detector inside the monochromator).

This configuration allows to obtain quantity of substance (an analyte) of interest in the drilling fluid, and, also utilizing two TR crystals—the pure spectrum of the gas or liquid, which may infuse from the formation being drilled, by subtracting the spectrum of the drilling liquid inside the tube from the spectrum of the liquid in the borehole outside the tube. The last may be a mixture of the drilling liquid with the influx from the formation.

Some of the advantages of the above-described optical spectroscopic sensor are:

- Diamond or sapphire may be used as the internal reflection element. It eliminates problems associated with attack on the sensing element's surface in high-pressure and high-temperature environment. The probe combines the chemical and pressure resistance of diamond with the flexibility and photometric accuracy of spectral analysis required for measurements and on-line process control in harsh environment.
- The sensor is a multitask apparatus, which can easily be re-tuned for identification of any chemical substance of interest via software. Optical-IR spectroscopy offers the advantages of continuous real-time direct monitoring of all the functional molecular groups which characterize molecular structure of the fluid, and the determination of hydrocarbon and water mixtures physical properties.
- The TR sampling method is not sensitive to small particle admixtures and successfully operates in a turbid liquid.
- The sensor is an all-solid-state and rigid device without moving parts.

This invention also provides a method of detecting the presence and relative quantity of a various materials in the drilling fluid by utilizing what is referred herein as "tags." In this method, any material containing hydrogen atoms, such as aqueous-based fluids, lubricants added to the drilling fluid, and emulsion-based fluids, such as olefins and linear alpha olefins can be tagged at the surface prior to supplying the drilling fluid with such materials to the borehole. The material to be tagged is combined with a suitable material that will replace one or more hydrogen atoms of the material to be tagged such as deuterium. The altered material is referred to as the "tagged material." A known quantity of the tagged material is mixed with the drilling fluid at the surface. A detector designed to detect the tagged material is disposed the drill string 20, preferably in the drilling assembly 90. During drilling, the detector detects the presence and relative quantity of the tagged material downhole. Comparison of the downhole measurements and the known values mixed at the surface provide information about the changes in such materials due to the drilling activity. The downhole processor 70 coupled to the detector transmits the computed measurements to the surface. If the downhole measurement and the surface known values differ more than a predetermined value, the amount of such material is adjusted to maintain the downhole values within a desired range. Several materials may be tagged at any given time. A separate detector for each tagged material or a common detector that can detect more than one type of tagged material may be utilized to detect the tagged materials.

In addition to the above-noted sensors, the drilling assembly 90 of the present invention also may include one or more sample collection and analysis device. Such a device is utilized to collect samples to be retrieved to the surface during tripping of the drill bit or for performing sample analysis during drilling. Also, in some cases it is desireable to utilize a sensor in the drilling assembly for determining lubricity and transitivity of the drilling fluid. Electrical properties such as the resistivity and dielectric constant of the wellbore drilling fluid may be determined from the abovenoted resistivity device or by any other suitable device. Drilling fluid resistivity and dielectric constant can provide information about the presence of hydrocarbons in water-based drilling fluids and of water in oil-based drilling fluids. Further, a high pressure liquid chromatographer packaged for use in the drill string and any suitable calorimeter may also be disposed in the drill string to measure chemical properties of the drilling fluid.

In the present invention, it is preferred that signals from the various above described sensors are processed downhole in one or more of the processors, such as processor 70 to determine a value of the corresponding parameters of interest. The computed parameters are then transmitted to the surface control unit 40 via the telemetry 72. The surface control unit 40 displays the parameters on display 42. If any of the parameters is out side its respective limits, the surface control unit activates the alarm 44 and/or shuts down the operation as dictated by programmed instructions provided to the surface control unit 40. The present invention provides in-situ measurements of a number of properties of the drilling fluid that are not usually computed downhole during the drilling operation. Such measurements are utilized substantially online to alter the properties of the drilling fluid and to take other corrective actions to perform drilling at enhanced rates of penetration and extended drilling tool life.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A drilling system for use in drilling a wellbore, said drilling system having a source supplying drilling fluid under pressure to the wellbore, comprising:

(a) a drill string having;

(i) a tubing adapted to extend from the surface into the wellbore;

(ii) a drilling assembly coupled to the tubing, said drilling assembly having a drill bit at an end thereof for drilling the wellbore; and (b) a plurality of pressure sensors disposed spaced apart alone a selected segment of the drill string for providing pressure measurements along the wellbore segment during the drilling of the wellbore (c) processor determining from the measurements of the plurality of the sensors pressure gradient over the segment, said processor further determining from the pressure gradient presence one of (i) of a kick in the wellbore and (ii) condition of a reservoir adjacent the wellbore, during drilling of the wellbore.

2. The drilling system according to claim 1, wherein the processor determines the presence of the kick from a sudden change in pressure between adjacent pressure sensors along the wellbore segment and by correlating said pressure measurements with at least one geological parameter.

3. The drilling system of claim 2 wherein the selected segment is one of (a) a section extending along the wellbore, (b) a section circumferentially disposed along the drill string.

4. The drilling system of claim 1 further comprising a plurality of temperature sensors carried by the drill string providing a temperature gradient of the wellbore fluid during drilling of the wellbore.

5. The drilling system of claim 4 wherein the processor determines condition of a reservoir surrounding the wellbore by utilizing measurements from said pressure and temperature sensors.

6. A drill string for use in drilling of a wellbore, said wellbore filled with a drilling fluid during drilling of the wellbore, comprising:

(a) a tubing adapted to extend from the surface into the wellbore;

(b) a drilling assembly coupled to the tubing, said drilling assembly having a drill bit at an end thereof for drilling the wellbore; and (c) a sensor carried by the drill string for determining a property of the drilling fluid downhole during the drilling of the wellbore, said sensor selected from a group of sensors consisting of (i) a sensor for determining density of a fluid sample; (ii) an acoustic sensor for determining density of the drilling fluid flowing through an annulus; (iii) an acoustic sensor for determining characteristics of cuttings in the drilling fluid; (iv) a sensor for determining viscosity of the drilling fluid; (v) a sensor for determining lubricity; (vi) a sensor for determining compressibility; (vii) a sensor for determining clarity of the drilling fluid; (viii) a sol-gel device for determining chemical composition of the drilling fluid; (ix) a fiber-optic sensor for determining a chemical property of the drilling fluid; (x) a spectrometer for determining a selected parameter of the drilling fluid; (xi) a sensor adapted to measure force required by a member to move over said drilling fluid; and (xii) a sensor for determining influx of the formation fluid into the wellbore.

7. A method of determining at a downhole location the relative amount of a selected component material included in a drilling fluid supplied from a surface source to a wellbore during the drilling of said wellbore, comprising:

(a) tagging a known quantity of the selected component material into the drilling fluid;

(b) adding the tagged component material to the drilling fluid and thereafter supplying said drilling fluid with the tagged component material to the wellbore during the drilling of the wellbore; and (c) taking measurements downhole of a parameter representative of the relative amount of the tagged component material in the drilling fluid by a sensor disposed in the wellbore.

8. The method of claim 7, wherein the chemical structure of the component material includes a hydrogen atom.

9. The method of claim 7 further comprising processing said measurements to determine the relative amount of the tagged material in the wellbore.

10. The method of claim 9 wherein said processing is done at least in part downhole.

11. The method of claim 9 further comprising determining the difference between the relative amount of the tagged component material determined from the downhole measurements and the relative amount of the tagged material added at the surface and adjusting the amount of such component material added to the drilling fluid if said difference is greater than a predetermined value.

12. A system for monitoring a parameter of interest of a drilling fluid in a wellbore during drilling of the wellbore, comprising:

(a) a downhole tool for use in the drilling of the wellbore; and (a) a spectrometric device carried by the downhole tool, said spectrometric device comprising:

an energy source supplying a selected form of energy;

at least one sensing element exposed to the drilling fluid, said sensing element providing signals responsive to the supplied energy representative of the parameter of interest; and a spectrometer for processing the signals from the sensing element to determine the parameter of interest.

13. The method of claim 12 wherein the spectrometric device includes:

(i) a light source;

(ii) an acousto-optical tunable filter-based monochromator; and (iii) an optical detector to detect reflected radiations.

14. The downhole tool of claim 13 wherein the spectrometric device is tuned to detect presence of a particular chemical in the drilling fluid.

15. The system of claim 12 wherein the parameter of interest is one of (a) presence of a hydrocarbon of interest in the drilling fluid, (b) presence of water in the drilling fluid, (c) amount of solids in the drilling fluid, (d) density of the drilling fluid, (e) composition of the drilling fluid downhole, (f) pH of the drilling fluid, and (g) presence of $H_2S$ in the drilling fluid.

16. The system of claim 12 wherein the selected energy is one of visible light, infrared, near infrared, ultraviolet, radio frequency, electromagnetic energy, and nuclear energy.

17. The system of claim 12 wherein the at least one sensing element includes at least two sensing elements for determining the parameter of interest of the drilling fluid in the downhole tool and in an annulus between the downhole tool and the wellbore.

18. The downhole tool of claim 12 wherein the processing is done at least in part downhole during drilling of the wellbore.

19. A downhole tool for use in drilling of a wellbore utilizing drilling fluid during said wellbore, said downhole tool comprising at least one fiber optic sensor providing measurements for an operating parameter of the drilling fluid during the drilling of the wellbore, said sensor being one of (i) a chemical sensor, and (ii) a radiation spectrometer.

20. A downhole tool for use in drilling a wellbore wherein a drilling fluid supplied from a surface location passes through the downhole tool and circulates through an annulus between the downhole tool and the wellbore during drilling of said wellbore, comprising said viscosity measuring device providing signals representative of the viscosity of the drilling fluid at a selected downhole location in the wellbore during drilling of the wellbore.

21. The downhole tool of claim 20 wherein the viscosity measuring device includes a pair of plates that receive a sample of the drilling fluid therebetween and provide signals corresponding to friction between the pair of the plates when said plates are moved relative to each other, the signals representing a measure of the viscosity of the drilling fluid at the selected downhole location.

22. The downhole tool of claim 20 further comprising a processor that processes signals from the viscosity measuring device at least in part downhole to determine the viscosity of the drilling fluid during drilling of the wellbore.

23. The downhole tool of claim 20 wherein the viscosity measuring device further includes a control valve for controlling supply of the drilling fluid to the viscosity measuring device.

24. The drilling system claim 23 wherein a processor controls the control valve for controlling the supply of the drilling fluid of the viscosity measuring device.

25. The downhole tool of claim 21 further comprising:

(i) a temperature sensor for providing temperature measurements of the drilling fluid in the wellbore;

(ii) a pressure sensor for providing pressure measurement of the drilling fluid in the wellbore; and wherein the processor in response to the temperature and pressure measurements determines the viscosity of the drilling fluid at the measured temperature and the pressure.

26. The downhole tool of claim 20 wherein the viscosity measuring device is selected from a group consisting of (i) a device measuring friction produced between two plates moving relative to each other and having the drilling fluid therebetween; and (ii) a rotating viscometer.

27. The drilling system of claim 26 wherein the processor processes the signals from the viscosity measuring device (i) at least in part downhole; or (ii) at the surface.

28. The drilling system of claim 26 further comprising:

(i) a temperature sensor for providing temperature measurement of the drilling fluid in the wellbore;

(ii) a pressure sensor for providing pressure of the drilling fluid in the wellbore; and wherein the processor in response to the temperature and pressure measurements determines the viscosity of the drilling fluid at the measured temperature and the pressure.

29. A drilling system for use in drilling of a wellbore, comprising:

(a) a tubing extending from a surface location into the wellbore;

(b) a source of drilling fluid supplying the drilling fluid under pressure into the tubing, said drilling fluid circulating to the surface via an annulus between the tubing and the wellbore;

(c) a drilling assembly at a bottom end of the tubing, said drilling assembly including:

(i) a drill bit for disintegrating rock formations surrounding the wellbore into cuttings, said cuttings flowing to the surface with the drilling fluid circulating through the annulus;

(ii) a viscosity measuring device providing signals representative of the viscosity of the drilling fluid at a selected downhole location; and (iii) a processors for processing signals from the viscosity measuring sensor to determine the viscosity of the drilling fluid at the selected downhole location during drilling of the wellbore.

30. The drilling system of claim 29 wherein the viscosity measuring device includes a pair of members wherein at least one member is moved relative to the other member by one of (i) a hydraulic device; and (ii) an electric device.

31. A method of drilling a wellbore with a drill string extending from a surface location into the wellbore, the drill string including tubing extending from the surface and into the wellbore, a drilling assembly carrying a drill bit attached to the tubing, said drill bit disintegration earth formation into cuttings during drilling of the wellbore, said method comprising:

(a) supplying a drilling fluid under pressure into toe tubing, said drilling fluid collecting cuttings and circulating to the surface via an annulus between the drill string and the wellbore;

(b) providing a density measuring device in the drilling assembly for providing signals representative of the viscosity of the drilling fluid at a selected downhole location in the wellbore; and (c) processing signals from the viscosity measuring device to determine the density of the drilling fluid at the selected downhole location.

32. The method of claim 31 wherein the processing is done at least in part downhole by a processor carried by the drilling assembly.

33. The method of claim 31 further comprising comparing the viscosity of the drilling fluid determined from the viscosity measuring device signals with a desired drilling fluid viscosity at the selected downhole location.

34. The method of claim 33 further comprising altering the viscosity of the drilling fluid supplied under pressure from the surface in response to the comparison of the drilling fluid viscosity.

35. A downhole tool for use in drilling of a wellbore wherein a drilling fluid supplied from a surface source passes through the tool, circulates through the wellbore and returns to the surface during drilling of the wellbore, said downhole tool including a density measuring device for providing signals representative of the density of the drilling fluid at a selected downhole location in the wellbore during drilling of the wellbore.

36. The downhole tool of claim 35 further comprising a processor for processing, at least in part downhole, the signals from the density measuring device to determine the density of the drilling fluid at the selected downhole location in the wellbore during the drilling of the wellbore.

37. The downhole tool of claim 35 wherein the density measuring device includes (i) a chamber for holding a column of the drilling fluid; and (ii) a sensor that provides differential pressure of the column of the drilling fluid.

38. The downhole tool of claim 35 wherein the density measuring device further includes a fluid control valve that controls flow of the drilling fluid into the chamber.

39. The downhole tool of claim 37 wherein the drilling fluid in the chamber is one of (i) drilling fluid with drilling cutting; and (ii) drilling fluid substantially free of the drill cuttings.

40. The downhole tool of claim 35 wherein the density measuring device comprises a sonic sensor for determining the density of the drilling fluid downhole.

41. The downhole tool of claim 36 further comprising:

(i) a temperature sensor for providing temperature measurements of the drilling fluid in the wellbore;

(ii) a pressure sensor for providing pressure of the drilling fluid in the wellbore; and wherein the processor in response to the temperature and pressure measurements determines the density of the drilling fluid at the measured temperature and the pressure.

42. A drilling system for use in drilling of a wellbore, comprising:

(a) a tubing extending from a surface location into the wellbore;

(b) a source of drilling fluid supplying the drilling fluid under pressure into the tubing, said drilling fluid circulating to the surface via annulus between the tubing and the wellbore;

(c) a drilling assembly at a bottom end of the tubing, said drilling assembly including:

(i) a drill bit for disintegrating rock formations surrounding the wellbore into cuttings, said cuttings flowing to the surface with the drilling fluid circulating through the annulus;

(ii) a density measuring device providing signals representative of the density of the drilling fluid at a selected downhole location; and (iii) a processors for processing signals from the density measuring sensor to determine the density of the drilling fluid at the selected downhole location during drilling of the wellbore.

43. The drilling system of claim 42 wherein the density measuring device is selected from a group consisting of: (i) a device that determines differential pressure of a column of the drilling fluid in the wellbore during drilling of the wellbore; and (ii) an acoustic sensor.

44. The drilling system of claim 42 wherein the processor processes the density sensor signals at least in part downhole to determine the density of the drilling fluid.

45. The drilling system of claim 42 wherein the processor is located at the surface and comprises a computer.

46. A method of drilling a wellbore with a drill string extending from a surface location into the wellbore, the drill string including a tubing extending from the surface to the wellbore, and a drilling assembly carrying a drill bit attached to the tubing, said drill bit disintegration earth formation surrounding the wellbore into cuttings during drilling of the wellbore, said method comprising:

(a) supplying a drilling fluid under pressure to the tubing, said drilling fluid collecting cuttings and circulating said cuttings to the surface via an annulus between the drill string and the wellbore;

(b) providing a density measuring device in the drilling assembly for providing signals representative of the density of the drilling fluid at a selected downhole location in the wellbore; and (c) processing signals from the density measuring device to determine the density of the drilling fluid at the selected downhole location.

47. The method of claim 46 wherein the processing is done at least in part downhole by a processor carried by the drilling assembly.

48. The method of claim 46 further comprising comparing the density of the drilling fluid determined from the density measuring device signals with a desired drilling fluid density at the selected downhole location.

49. The method of claim 48 further comprising altering the density of the drilling fluid supplied under pressure from the surface in response to the comparison of the drilling fluid density.

50. The method of claim 46 further comprising determining from the measurement of the density of the drilling fluid at the selected downhole location at least one of (i) gas contamination in the drilling fluid; (ii) solids contamination in the drilling fluid; (iii) barite sag in the drilling fluid; and (iv) a measure of the effectiveness of transportation of the drill cuttings by the drilling fluid.

51. The method of claim 46 further comprising:

(i) determining temperature of the drilling fluid downhole;

(ii) determining pressure of the drilling fluid downhole; and (iii) processing signals from the density measuring device to determine the density of the drilling fluid at the downhole measured temperature and pressure.

52. A downhole tool for use in drilling of a wellbore wherein a drilling fluid supplied from a surface source passes through the tool, circulates through the wellbore and returns to the surface during drilling of the wellbore, said downhole tool including a compressibility measuring device for providing signals representative of the compressibility of the drilling fluid at a selected downhole location in the wellbore during drilling of the wellbore.

53. The downhole tool of claim 52 wherein the compressibility measuring device includes a chamber for receiving the drilling fluid and a piston for compressing the fluid in the chamber, said compressibility measuring device providing signals representative of the movement of the piston.

54. The downhole tool of claim 52 further comprising a processor for determining compressibility of the drilling fluid from the signals provided by the compressibility measuring device.

55. The downhole tool of claim 54 further comprising a telemetry system for transmitting signals representative of the compressibility of the drilling fluid to a surface location.

56. The method of claim 54 further comprising determining from the compressibility of the drilling fluid presence of gas in the drilling fluid and thereby kick in the wellbore.

57. The method of claim 56 further comprising taking a corrective action upon determination of the kick in the wellbore.

58. A method of determining compressibility of drilling fluid downhole during drilling of a wellbore, comprising:

(a) drilling the wellbore with a drilling assembly by circulating through the wellbore a drilling fluid supplied under pressure from a surface location;

(b) providing a compressibility measuring device for providing signals representative of the compressibility of the drilling fluid downhole; and (c) processing the compressibility device signals to determine the compressibility of the drilling fluid.

59. The method of claim 58 wherein said processing includes processing the signals by a processor, at least in part downhole, during drilling of the wellbore.

60. The downhole tool of claim 59 further comprising a processor for processing, at least in part downhole, the signals from the clarity measuring device to determine the clarity of the drilling fluid at the selected downhole location in the wellbore during the drilling of the wellbore.

61. The downhole tool of claim 60 wherein the processor determines the clarity substantially continuously.

62. A downhole tool for use in drilling a wellbore wherein a drilling fluid supplied from a surface source passes through the tool and circulates through the wellbore and returns to the surface during drilling of the wellbore, said downhole tool including a clarity measuring device for providing signals representative of the clarity of the drilling fluid at selected downhole location in the wellbore during drilling of the wellbore.

63. The downhole tool of claim 62 wherein the clarity measuring device is an optical device.

64. The downhole tool of claim 63 wherein the clarity measuring device includes a light source transmitting light through a body of the drilling fluid in the wellbore to provide measurements representative of the clarity of the drilling fluid during drilling of the wellbore.

* * * * *